US012600531B2

(12) United States Patent
Ahn

(10) Patent No.: US 12,600,531 B2
(45) Date of Patent: Apr. 14, 2026

(54) CONTAINER LID, AND CONTAINER ASSEMBLY HAVING SAME COUPLED THERETO

(71) Applicant: Jin Hee Ahn, Yongin-si (KR)

(72) Inventor: Jin Hee Ahn, Yongin-si (KR)

( * ) Notice: Subject to any disclaimer, the term of this patent is extended or adjusted under 35 U.S.C. 154(b) by 258 days.

(21) Appl. No.: 18/245,456

(22) PCT Filed: Sep. 23, 2021

(86) PCT No.: PCT/KR2021/012970
§ 371 (c)(1),
(2) Date: Mar. 15, 2023

(87) PCT Pub. No.: WO2022/065883
PCT Pub. Date: Mar. 31, 2022

(65) Prior Publication Data

US 2023/0348152 A1 Nov. 2, 2023

(30) Foreign Application Priority Data

Sep. 23, 2020 (KR) ..... 10-2020-0124811
Nov. 9, 2020 (KR) ..... 10-2020-0149278
(Continued)

(51) Int. Cl.
*B65D 51/18* (2006.01)
*B65D 41/04* (2006.01)
(Continued)

(52) U.S. Cl.
CPC ..... *B65D 43/0231* (2013.01); *B65D 51/28* (2013.01); *B65D 53/04* (2013.01)

(58) Field of Classification Search
CPC .. B65D 43/0231; B65D 51/28; B65D 51/228; B65D 53/04; B65D 2215/02; B65D 2215/0093; B65D 50/066
(Continued)

(56) References Cited

U.S. PATENT DOCUMENTS 1,966,273 A * 7/1934 Waring ..... B65D 53/04 215/232
2,524,365 A 10/1950 Smith
(Continued)

FOREIGN PATENT DOCUMENTS

JP 2004083080 A 3/2004
JP 2008062948 A 3/2008
(Continued)

*Primary Examiner* — Gideon R Weinerth
(74) *Attorney, Agent, or Firm* — Rabin & Berdo, P.C.

(57) ABSTRACT

The present invention relates to a container lid, and a container assembly having same coupled thereto and, more specifically, to a container lid coupled to a container inlet through which contents are received, and a container assembly having the container lid coupled thereto. Disclosed is a container assembly comprising: a container for receiving contents; a container lid coupled to the container inlet; and a sealing member having a bottom surface attached to an upper end of the container inlet of the container, and coupled to the container lid, wherein, when the container lid is separated from the container by means of rotation, adhesiveness between the sealing member and the container lid is greater than adhesiveness between the container inlet and the sealing member such that the sealing member is separated from the container inlet.

15 Claims, 28 Drawing Sheets

(30) Foreign Application Priority Data

| | | |
|---|---|---|
| Jan. 29, 2021 | (KR) | 10-2021-0014116 |
| Apr. 30, 2021 | (KR) | 10-2021-0057199 |
| Jun. 1, 2021 | (KR) | 10-2021-0071484 |
| Aug. 4, 2021 | (KR) | 10-2021-0103069 |
| Sep. 10, 2021 | (KR) | 10-2021-0121763 |

(51) Int. Cl.
*B65D 43/02* (2006.01)
*B65D 51/28* (2006.01)
*B65D 53/04* (2006.01)

(58) Field of Classification Search
USPC ..... 220/200; 215/DIG. 8; 222/83
See application file for complete search history.

(56) References Cited

U.S. PATENT DOCUMENTS 2,620,939 A * 12/1952 Weisgerber ..... B65D 41/045 53/317
2,631,521 A * 3/1953 Atkins, Jr. ..... B65D 51/2814 426/115
2,670,869 A * 3/1954 Martin ..... B65D 41/0435 215/354
3,330,720 A * 7/1967 Stevens ..... B65D 41/045 428/327
3,331,523 A * 7/1967 Exton ..... B65D 41/0435 215/350
3,355,238 A 11/1967 Schwartzman
3,406,872 A * 10/1968 Fiquet ..... B65D 47/38 222/499
3,501,042 A * 3/1970 Grumbles ..... B65D 51/20 215/232
3,715,063 A * 2/1973 Susuki ..... B65D 51/18 222/545
4,109,815 A * 8/1978 Collins, III ..... B65D 51/20 215/277
4,111,325 A * 9/1978 Bellamy ..... B65D 51/228 215/253
4,181,232 A * 1/1980 Bellamy ..... B65D 51/228 215/253
4,434,904 A * 3/1984 D'Amico ..... B65D 55/02 215/253
4,793,504 A * 12/1988 Towns ..... B65D 55/066 215/250
4,795,043 A * 1/1989 Odet ..... B65D 51/224 215/250
4,893,718 A * 1/1990 Delespaul ..... B29C 66/72321 215/232
4,930,646 A * 6/1990 Emslander ..... B65D 41/045 215/347
5,111,978 A * 5/1992 Mengeu ..... B65D 51/18 222/545
5,184,746 A * 2/1993 Moore ..... B65D 47/185 215/349
5,228,592 A * 7/1993 Pellerano ..... B65D 51/224 222/91
5,704,501 A * 1/1998 Valyi ..... B65D 51/228 215/258
5,915,577 A * 6/1999 Levine ..... B65D 41/045 428/458
6,082,568 A * 7/2000 Flanagan ..... B65D 51/20 222/153.07
6,164,503 A * 12/2000 Forsyth ..... B65D 51/20 222/153.05
6,877,630 B2 * 4/2005 von Spreckelsen ... B65D 41/04 220/258.1
7,279,187 B2 * 10/2007 Daniels ..... C02F 1/68 426/106
7,380,678 B1 * 6/2008 Johnsen ..... B65D 51/1688 215/349
7,780,024 B1 * 8/2010 Marsella ..... B65D 41/045 215/276
8,443,970 B2 * 5/2013 Coon ..... B65D 51/2835 206/219
8,770,428 B2 * 7/2014 Brauer ..... B65B 7/2835 220/359.3
9,862,528 B2 * 1/2018 Isogai ..... B65D 51/228
10,287,039 B2 * 5/2019 Heyn ..... B65B 51/227
2004/0200742 A1 * 10/2004 Cho ..... B65D 51/2835 206/219
2006/0151421 A1 * 7/2006 Rho ..... B65D 51/247 220/521
2007/0007229 A1 * 1/2007 Yousif ..... B32B 27/06 220/359.3
2007/0045134 A1 * 3/2007 Dvorak ..... B65D 41/3428 206/222
2008/0164234 A1 * 7/2008 Rho ..... B65D 51/228 215/220
2009/0218348 A1 * 9/2009 Rho ..... B65D 51/228 220/315
2009/0301988 A1 * 12/2009 Rho ..... B65D 51/228 215/316
2010/0000996 A1 * 1/2010 Rho ..... B65D 51/224 220/258.3
2011/0100988 A1 * 5/2011 Fraser ..... B65D 51/228 220/254.1
2011/0220651 A1 * 9/2011 Rho ..... B65D 53/04 220/378
2013/0175188 A1 * 7/2013 Scarpa ..... B65D 81/32 206/222
2013/0186779 A1 * 7/2013 Kambouris ..... B65D 51/28 206/222
2013/0291441 A1 * 11/2013 Rho ..... B65D 51/228 49/483.1
2023/0192372 A1 * 6/2023 Ahn ..... B65D 51/28 220/521
2023/0348152 A1 * 11/2023 Ahn ..... B32B 15/095
2024/0239573 A1 * 7/2024 Ahn ..... B65D 47/0857
2024/0239574 A1 * 7/2024 Lindsey ..... B65D 47/103

FOREIGN PATENT DOCUMENTS

| | | | |
|---|---|---|---|
| JP | 2008532870 | A | 8/2008 |
| JP | 4515019 | B2 | 7/2010 |
| JP | 2013545680 | A | 12/2013 |
| JP | 2015-048095 | A | 3/2015 |
| KR | 20060064959 | A | 6/2006 |
| KR | 20060069817 | A | 6/2006 |
| KR | 100755037 | B1 | 9/2007 |
| KR | 10-2008-0009968 | A | 1/2008 |
| KR | 10-1165973 | B1 | 7/2012 |

* cited by examiner

RELATED ART

FIG. 18A
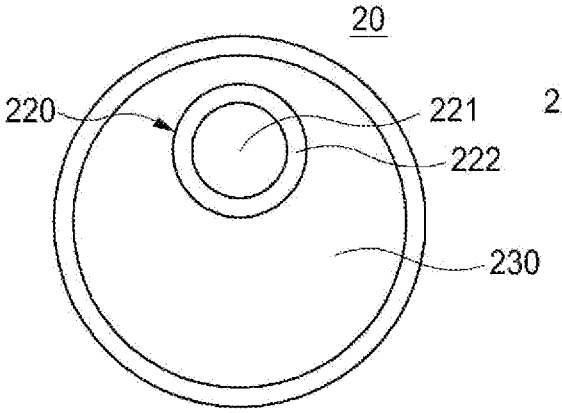
FIG. 18B
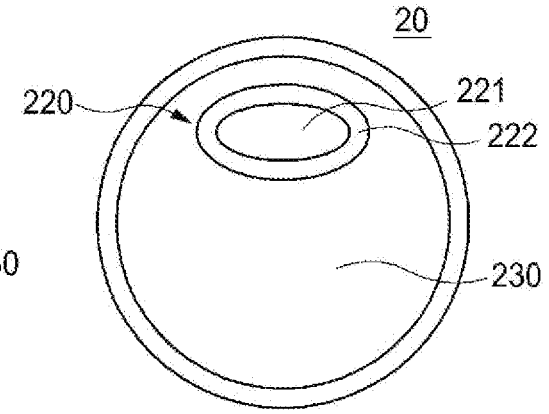
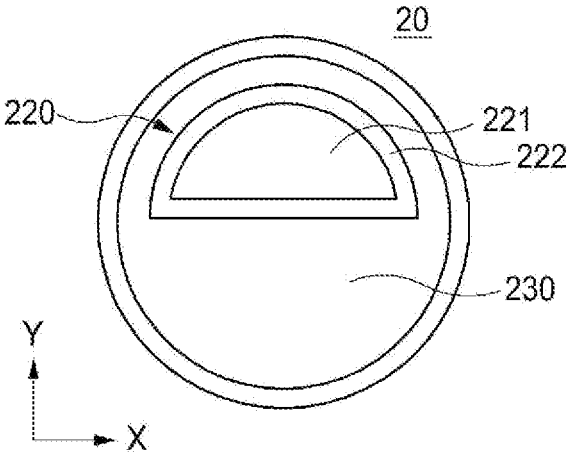
FIG. 18C
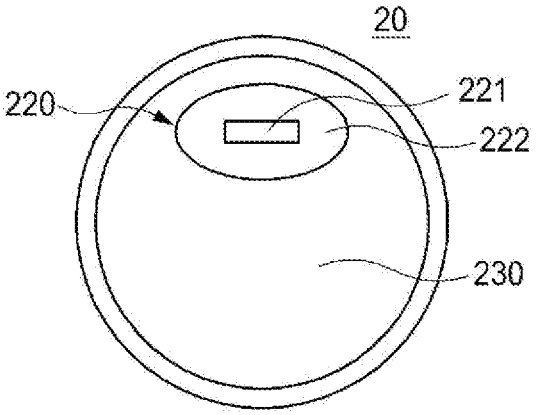
FIG. 18D

CONTAINER LID, AND CONTAINER ASSEMBLY HAVING SAME COUPLED THERETO

TECHNICAL FIELD

The present invention relates to a container lid, and a container assembly having same coupled thereto and, more specifically, to a container lid coupled to a container inlet through which contents are received, and a container assembly having the container lid coupled thereto.

BACKGROUND ART

FIG. 1 is a cross-sectional view of a container according to the related art.

In general, a container for drinking water such as lactic beverages are provided with a sealing member mounted to a container inlet 102 to prevent the contents stored in a container 104 from leaking out accidentally, and accordingly, a sealing member 114 for sealing the contents stored in the container 104 is attached to the container inlet 102. Also, a container lid 100 for preventing the sealing member 114 from being accidentally damaged due to external impact or contact between objects is covered.

The container lid 100 has a cylindrical shape that is sealed on the upper side and includes, on the inner circumferential surface, a locking jaw 110 locked to a locking rib 108 formed on the outer circumferential surface of the container inlet 102. In addition, the container lid is provided with a handle 112 that is held and pulled by a hand when the container lid 100 is separated from the container inlet 102.

With respect to the container lid 100, the container lid 100 is separated from the container inlet 102 by holding and pulling the handle 112, and then, the sealing member 114 is removed from the container inlet 102. Accordingly, the contents contained in the container are discharged to the outside via the container inlet 102.

However, with respect to the container lid according to the related art as described above, the container lid is separated from the container. Subsequently, the sealing member sealed and attached to the container inlet has to be removed by hand or removed using a separate tool such as a knife. However, this causes inconvenience in use.

In particular, when the sealing member is removed by hand, a bonding force between the sealing member and the edge of the container inlet is strong, and thus, the sealing member is not smoothly separated from the edge. Accordingly, it is inconvenient to remove the sealing member by hand again, and in this case, the hand comes into contact with the container inlet, which may cause hygiene problems.

DISCLOSURE OF THE INVENTION

Technical Problem

Accordingly, the present invention has been made to solve the above problems according to the related art, and an objective of the present invention is to provide a container lid and a container assembly having same coupled thereto, wherein a sealing member that seals a container inlet is separated when the container lid is separated from a container. Thus, it is convenient to use because there is no need to separately remove the sealing member.

Technical Solution

The present invention has been made to achieve the above objective. Disclosed is a container assembly including: a container (10) for receiving contents; a container lid (20) coupled to the container inlet (12); and a sealing member (30) which has a bottom surface attached to an upper end of the container inlet (12) of the container (10) and is coupled to the container lid (20), wherein, when the container lid (20) is separated from the container (10) by means of rotation, adhesiveness between the sealing member (30) and the container lid (20) is greater than adhesiveness between the container inlet (12) and the sealing member (30) such that the sealing member (30) is separated from the container inlet (12).

The upper surface of the sealing member (30) may adhere to the container lid (20).

The container lid (20) may include: a lid body (210) coupled to the container inlet (12); and a sealing member detacher (220) which is installed in the lid body (210) and separates the sealing member (30) from the lid body (210).

The lid body (210) may include a coupling portion (230) which corresponds to a region coupled to an upper surface (12*a*) of the container inlet (12) and to which an upper surface of an edge (31) of the sealing member (30) is attached.

The coupling portion (230) may have a flat surface in close contact with the upper surface of the sealing member (30).

One of the coupling portion (230) and the upper end of the container inlet (12) may have a groove, and a portion of the other one may be inserted into the groove so that the other one is inserted into and brought into close contact with the one.

The coupling portion (230) may have the groove (S2) into which the upper end of the container inlet (12) is inserted.

The sealing member detacher (220) may include: a push portion (221) which moves downward, presses the sealing member (30), and separates the sealing member (30) from the lid body (210); and a connection portion (222) which connects the lid body (210) and the push portion (221) to each other such that the push portion (221) is moved downward by elastic deformation.

The push portion (221) may have, on a bottom surface, one or more pressing portions 223 that press the sealing member (30).

The connection portion (222) may be formed integrally with the push portion (221) and the lid body (210).

The connection portion (222), together with the push portion (221), may isolate upper and lower regions of the lid body (210) from each other.

The connection portion (222) may have a plurality of bands that are elastically deformable between the inner circumference of the lid body (210) and the push portion (221).

The sealing member detacher (220) may be integrally formed with the lid body (210) such that the container (10) is sealed when the lid body (210) is coupled to the container inlet (12).

Disclosed is a container lid used in a container assembly, wherein the container assembly includes: a container (10) for receiving contents; a container lid (20) coupled to the container inlet (12); and a sealing member (30) which has a bottom surface attached to an upper end of the container inlet (12) of the container (10) and is coupled to the container lid (20).

Advantageous Effects

1. Eco-Friendly and Recyclable

In a container lid and a container assembly having same coupled thereto according to the present invention, a sealing member 30 sealing (blocking) an upper surface 12*a* of a container inlet 12 is automatically separated together with a container lid 20 when the container lid 20 is opened from the container inlet 12. Accordingly, recycling (eco-friendly) of the container 10 is possible without a need to treat the container 10 as waste. In addition, since the sealing member 30 separated from the container inlet 12 may be stored/separated from the container lid 20, both the container lid 20 and the container 10 may be recycled.

In addition, in the container lid and the container assembly having same coupled thereto according to the present invention, when the container lid 20 is separated from the container 10, the sealing member 30 is removed from the container inlet 12 without any residual. Accordingly, there is an advantage in that recycling may be performed smoothly.

Furthermore, since the sealing member 30, which is made of a different material, is completely separable from the container lid 20 without a residual, there is an advantage in that the container lid 20 may be recycled smoothly.

2. Contents Can Be Safely Stored

According to an embodiment of the sealing member, when the container lid 20 is re-assembled after opening, a lower layer of the sealing member 30 and the upper surface 12*a* of the container inlet 12 are joined again. Accordingly, a blocking function is formed, and the safe storage of contents is possible.

3. Existing Production Lines Can Be Used

The present invention may be configured to have the same external dimensions (width, height) as an existing container lid and an existing container. Therefore, since there is no need to change an existing production line with an additional cost, the present invention may be rapidly spread to related industries around the world.

BRIEF DESCRIPTION OF THE DRAWINGS

FIGS. 18A to 18D are plan views showing modified examples of a shape of a push portion of a container lid illustrated in FIG. 2.

MODE FOR CARRYING OUT THE INVENTION

Figure 1:
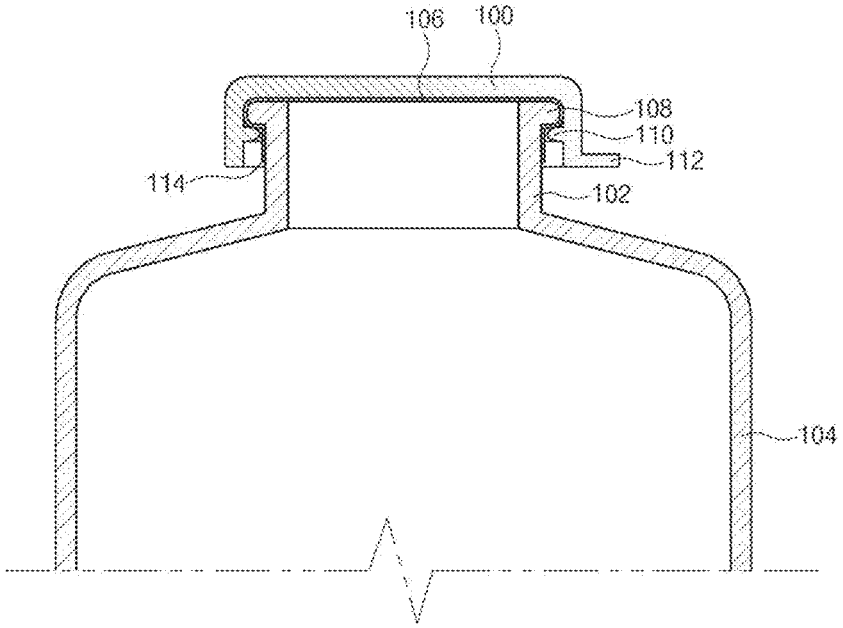
FIG. 1 is a cross-sectional view of a container lid according to the related art.
Figure 2:
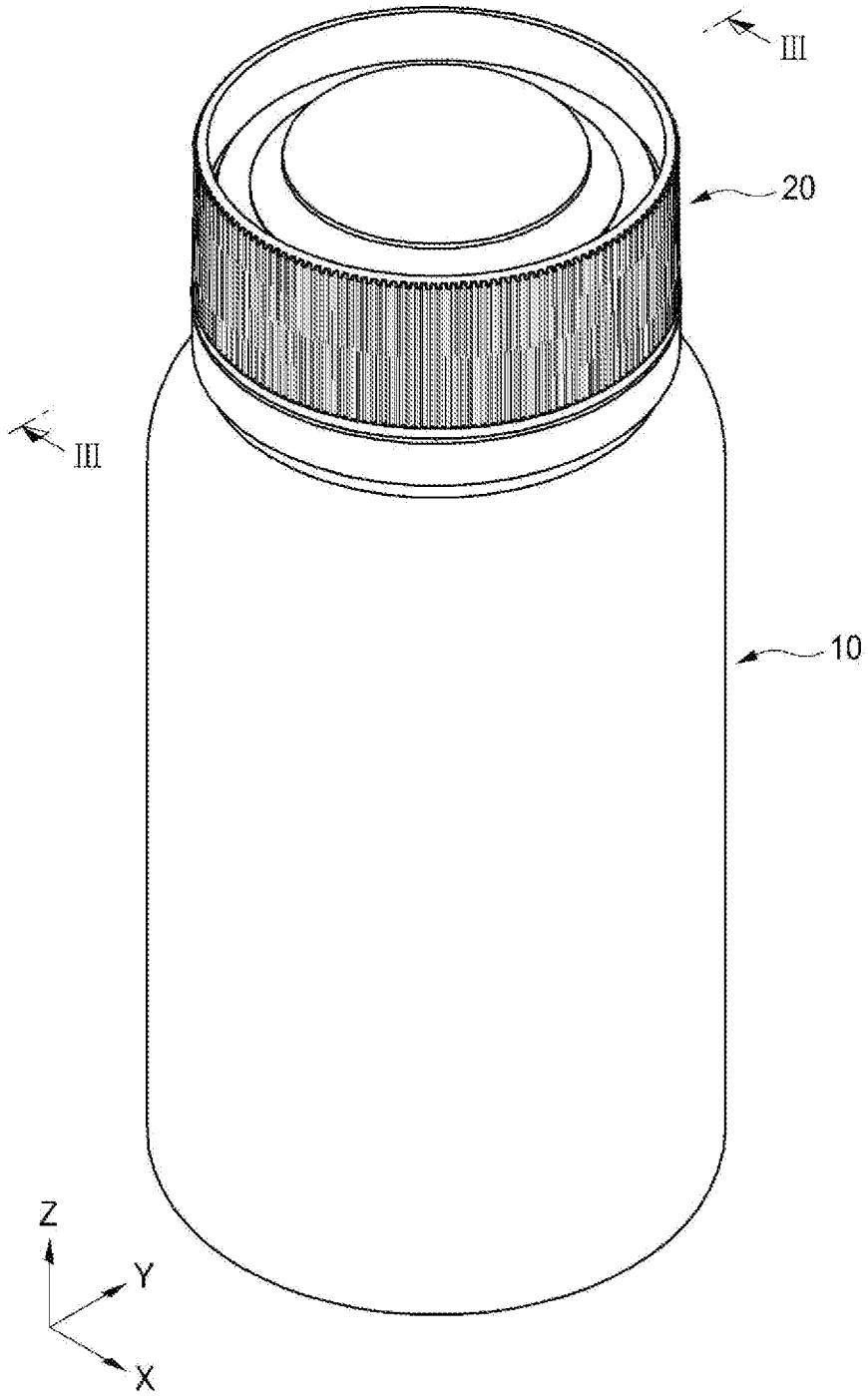
FIG. 2 is a perspective view showing a container assembly according to a first embodiment of the present invention.

Hereinafter, a container lid and a container having same coupled thereto according to the present invention will be described with reference to the accompanying drawings.

As illustrated in FIGS. 2 to 22, a container assembly according to the present invention includes a container 10 for receiving contents, a container lid 20 coupled to the container inlet 12, and a sealing member 30 which has a bottom surface attached to an upper end of the container inlet 12 of the container 10 and is coupled to the container lid 20 to thereby seal the container 10.

The container 10 is configured to contain liquid materials, such as beverages, alcoholic beverages, engine oil, anti-freeze, cooking oil, and dairy products, and powder-type materials, and various configurations are possible as long as the container has the container inlet 12 for discharging materials from the container.

The contents contained in the container 10 may include various substances such as a liquid material in which auxiliary contents descried below are drunk together with solid pills, depending on a combination of the contents and the auxiliary contents. The contents usually include a liquid material.

Also, in the container 10, a portion except for the container inlet 12 may have various shapes, such as a cylindrical shape and a quadrangular pillar shape.

Also, the container 10 may have a plastic material, a ceramic material such as potteries, a glass material, a metal material, and other various materials. Here, the container lid is preferably made of a plastic material in consideration of manufacturing, breakage separation, and the like.

Meanwhile, the container inlet 12 serves as an outlet through which the contents are discharged to the outside, and is a part that is opened and closed by the opening and closing of the container lid 100, and various structures are possible depending on the coupling structure with the container lid 20.

The container lid 20 is a component that is coupled to the container inlet 12 of the container 10 to seal the container 10, and may have various configurations.

In particular, the container lid 20 may have various configurations depending on the coupling structure with the sealing member 30 and the container inlet 12.

Also, the material of the container lid 20 may include a plastic material, and any configuration is possible as long as the material can be injection-molded such as HDPE, PP, PET, PVC, and PS.

The sealing member 30 has a bottom surface attached to an upper end of the container inlet 12 of the container 10 and is coupled to the container lid 20 to seal the container 10, and may have various configurations depending on the coupling structure with the container lid 20.

In particular, in order for the sealing member 30 to be separated from the container inlet 12 when the container lid 20 is separated from the container 10 by means of rotation, adhesiveness between the sealing member 30 and the container lid 20 is greater than adhesiveness between the container inlet 12 and the sealing member 30.

Figure 16:
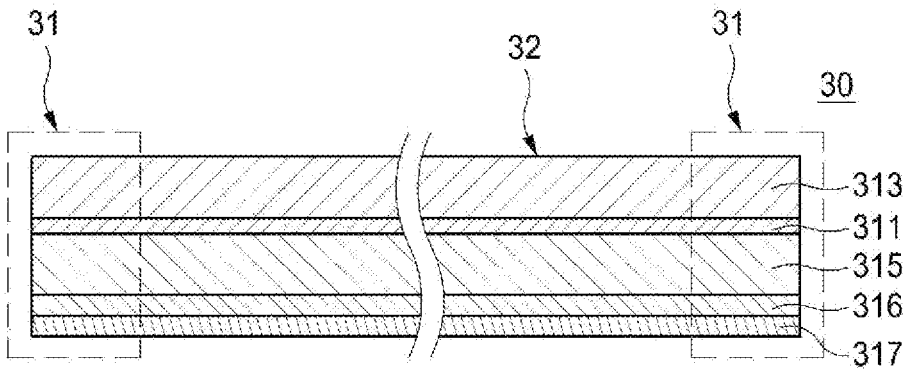
FIG. 16 is a partial cross-sectional view showing an example of a sealing member installed in a container assembly illustrated in FIG. 3.

For example, as illustrated in FIG. 16, the sealing member 30 may include a metal sheet layer 311, and a first resin layer 313 and a second resin layer 315 which are respectively coupled to the upper and lower surfaces of the metal sheet layer 311.

The metal sheet layer 311 is a metal layer that provides rigidity to the sealing member 30 and allows the sealing member to be attached to the upper surface 12*a* of the container inlet 12 by means of an induction or conduction method. In addition to aluminum and aluminum alloy materials, any metal material used for commercial sealing members may be used therefor.

The metal sheet layer 311 may have a thickness of 6 μm to 200 μm.

The first resin layer 313 and the second resin layer 315 may include resin layers coupled to the upper and lower surfaces of the metal sheet layer 311, and in particular, may be made of PET.

The first resin layer 313 and the second resin layer 315 may have a thickness of 10 μm to 150 μm.

Figure 17A:
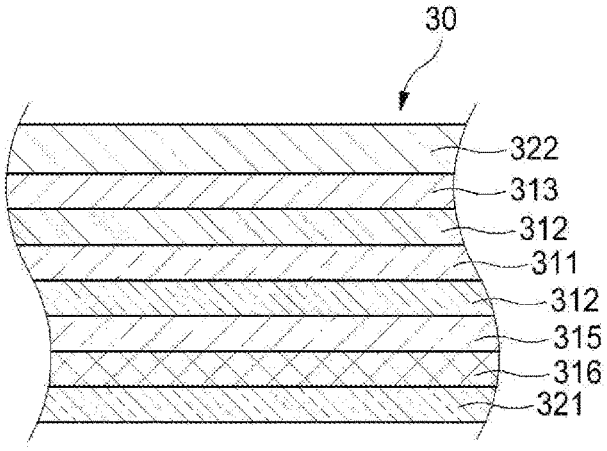
FIGS. 17A to 17C are partial cross-sectional views showing modified examples of a sealing member illustrated in FIG. 16.
Figure 17B:
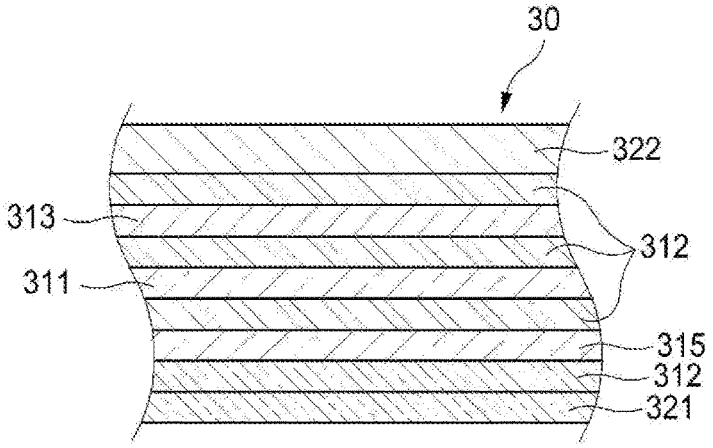
Figure 17C:
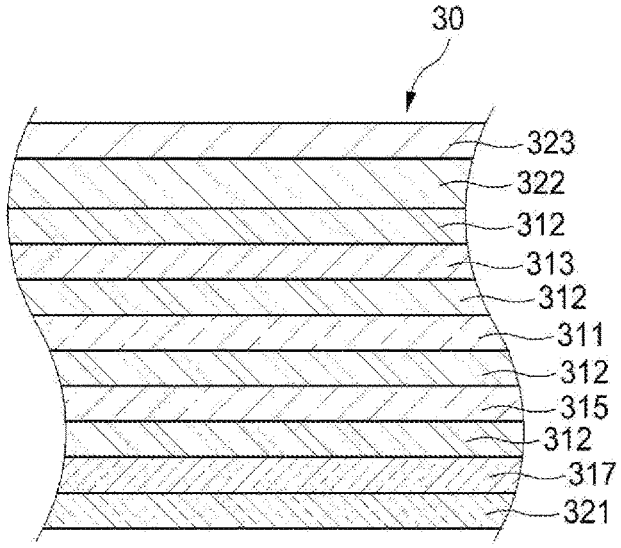
Figure 19:
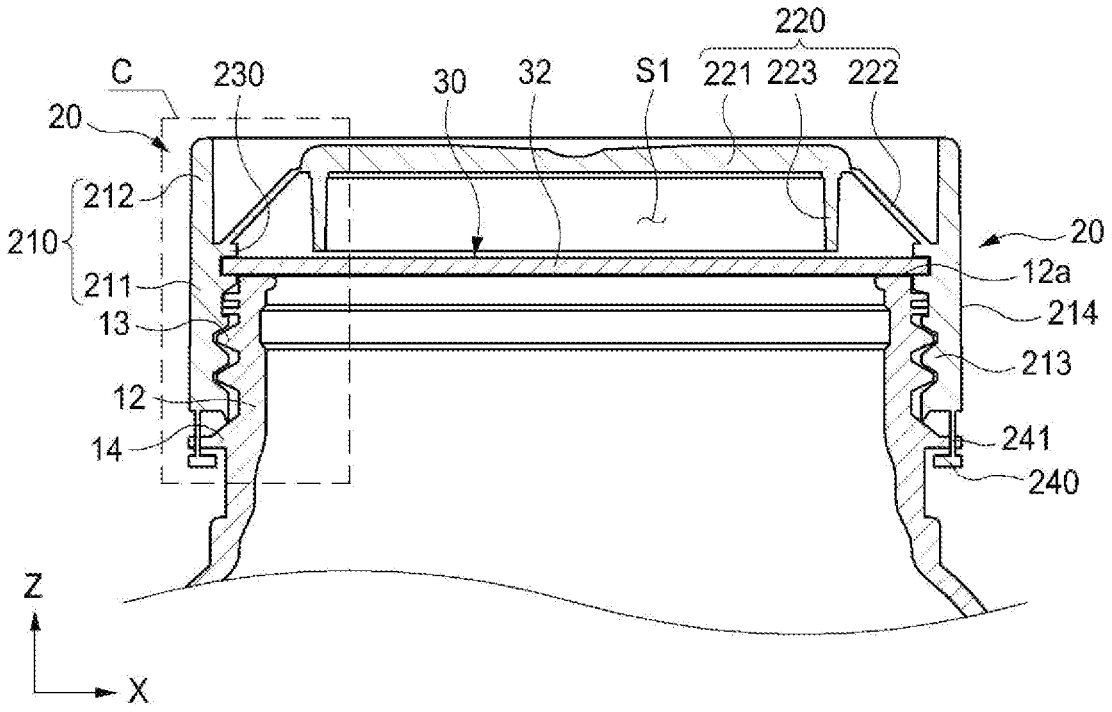
FIG. 19 is a partial cross-sectional view showing a modified example of a container assembly illustrated in FIG. 3.
Figure 20:
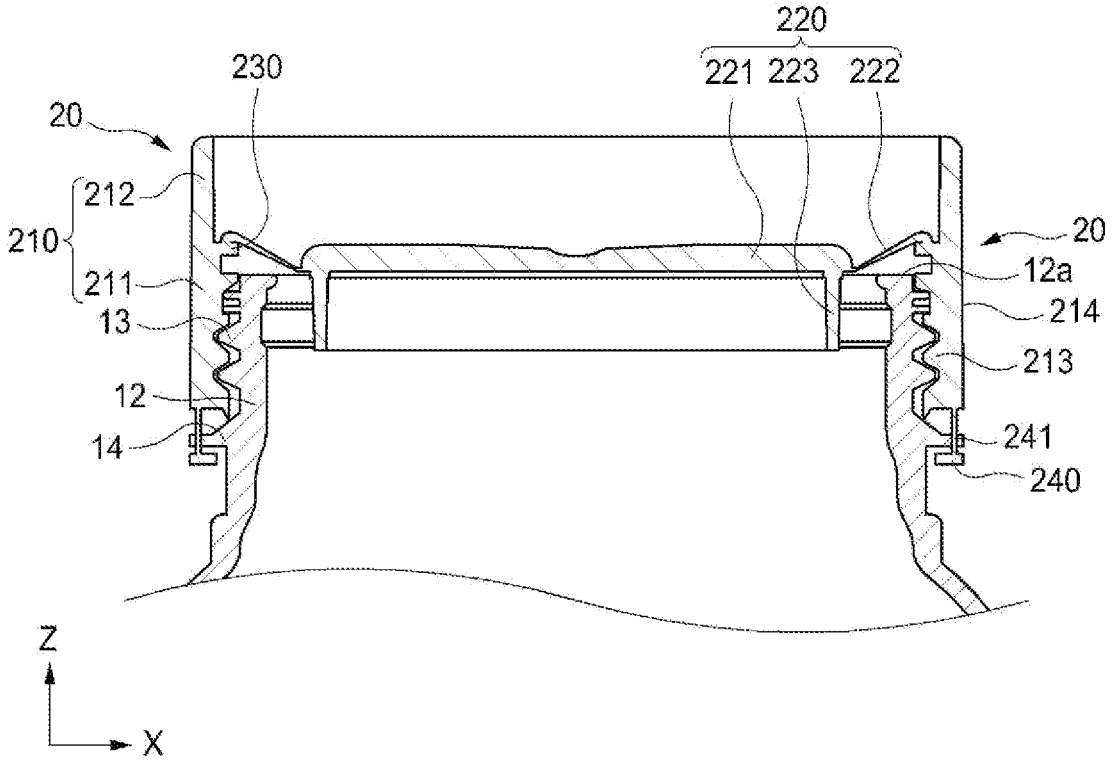
FIG. 20 is a partial cross-sectional view showing a state in which a container lid, from which a sealing member has been removed in a container assembly of FIG. 19, is coupled to a container.

Here, as illustrated in FIGS. 17A to 17C, the first resin layer 313 and the second resin layer 315 may be respectively bonded to the upper and bottom surfaces of the metal sheet layer 311 by bonding layers 312 on the surface of the aluminum sheet material.

Here, each of the bonding layers 312 includes a material for bonding a resin layer such as PET to the surface of the aluminum sheet material, and an adhesive of a commercial sealing member described below may be used therefor.

The sealing member 30 having the above structure facilitates sealing and separation with respect to the container 10. The sealing member may seal the container 10 with a sufficient adhesive force due to the adhesiveness when the container lid 20 is coupled to the container inlet 12, and may be easily separated when the container lid 20 is separated from the container inlet 12.

For reference, since the end of an edge portion 31 of the sealing member 30 is inserted into the container lid 20, the sealing member may be separated from the container inlet 12 while being fixed to the container lid 20 when the container lid 20 is separated.

In particular, a portion of the edge portion 31 of the bottom surface of the sealing member 30 is also attached to the upper surface of a support portion 233. Therefore, the sealing member 30 may have the adhesiveness to the container lid 20 greater than the adhesiveness to the upper surface 12*a* of the container inlet 12.

Here, in addition to the above-described embodiment, the sealing member 30 may have various embodiments depending on the materials of the container 10 and the container lid 20 for adhesion to the upper surface 12*a* of the container inlet 12 and adhesion to the container lid 20.

In particular, the sealing member 30 may have a functional layer for imparting an easy-peel function on at least one of the upper or bottom surface.

For example, in the sealing member 30, a CPP layer 317 may be formed on the bottom surface of the second resin layer 315, as a structure to be applied to the container assembly according to the present invention.

The CPP layer 316, together with the adhesive layer 317, is a layer having a thermal bonding property for imparting an easy-peel function, and has a material of casting poly propylene.

The CPP layer 316 may have a thickness of 10 μm to 30 μm.

In the sealing member 30, an adhesive layer 317 for adhesion with the upper surface 12*a* of the container inlet 12 may be formed on the bottom surface of the CPP layer 316 to increase the bonding performance to the container inlet 12.

The adhesive layer 317 is a layer for adhesion to the upper surface 12*a* of the container inlet 12, and may include an easy-peel material commonly used for adhesion between resins.

The adhesive layer 317 may have a thickness of 10 μm to 500 μm.

Also, the sealing member 30 according to the present invention should have the adhesiveness to the container inlet 12 less than the adhesiveness to the container lid 20, and thus, the adhesive performance provided with an easy-peel function is preferable.

To this end, as an easy-peel layer for imparting an easy-peel function in the sealing member 30 according to the present invention, an easy-peel layer, which includes acryl, urethane, polyethylene (LDPE, LLDPE, MDPE, HDPE), metallocene polyethylene, polypropylene, SBR (styrene-butadiene-rubber), EVA, EAA, EEA, EMAA, EMA, ionomer, Surlyn, polyester, co-polymer, and easy peel resin, or the like, may be formed on a surface that contacts the upper surface 12*a* of the container inlet 12.

As another example of the sealing member 30, the sealing member 30 may include 7 layers which are, from above, an easy-peel coating agent layer 322 (1 to 100 μm), 2) a PET layer 313 (12 to 350 μm) that is a polyester film, 3) a polyurethane bonding agent layer 312 (1 to 12 μm), 4) an aluminum foil layer 311 (1 to 100 μm) that is a hard material, 5) a polyurethane bonding agent layer 312 (1 to 12 μm), 6) a PET layer 315 (12 to 350 μm) that is a polyester film, and 7) an easy-peel coating agent layer 321 (1 to 100 μm).

As another example, the sealing member 30, as illustrated in FIG. 17A, may have a total of 8 layers which further include a polyurethane bonding agent layer 312 having a thickness of 1 to 12 μm between the PET layer 315 (12 to 350 μm) that is a polyester film and the easy-peel coating agent layer 321 (1 to 100 μm).

The Easy-Peel film is the easy-peel film described above, and Co-Polyester film and Easy-Peel Co-EX film may also be used therefor.

As another example, the sealing member 30, as illustrated in FIG. 17B, may include 9 layers which are, from above, an Easy-Peel film 322 ([1 to 100 μm])/an adhesive 312 ([1 to 20 μm])/a PET film 313 ([12 to 350 μm])/an adhesive 312 ([1 to 20 μm])/an aluminum foil 311 ([1 to 100 μm])/an adhesive 312 ([1 to 20 μm])/a PET film 315 ([12 to 350 μm])/an adhesive 312 ([1 to 20 μm])/an Easy-Peel film 321 ([1 to 100 μm]).

The Easy-Peel film is the easy-peel film described above, and Co-Polyester film and Easy-Peel Co-EX film may also be used therefor.

As another example, the sealing member 30, as illustrated in FIG. 17C, may include 11 layers which are, from above, an Easy-Peel coating 323 ([1 to 100 μm])/a Co-EX film 322 ([10 to 100 μm])/an adhesive 312 ([1 to 20 μm])/a PET film 313 ([12 to 250 μm])/an adhesive 312 ([1 to 20 μm])/an aluminum foil 311 ([1 to 100 μm])/an adhesive 312 ([1 to 20 μm])/a PET film 315 ([12 to 250 μm])/an adhesive 312 ([1 to 20 μm])/a Co-EX film 317 ([10 to 100 μm])/an Easy-Peel coating 321 ([1 to 100 μm]).

Additional Embodiments of the Structure of a Sealing Member According to the Materials of a Container Lid and a Container

A) Container Lid Including a Material of Polyethylene (PE) and Container Including a Material of Polypropylene (PP)

From the bottom surface, 1) a PP layer of 0.5 μm to 150 μm, 2) a bonding layer of 0.5 μm to 10 μm, 3) a PET layer of 10 μm to 150 μm, 4) a bonding layer of 0.5 μm to 10 μm, 5) a metal sheet (aluminum) layer of 6 μm to 200 μm, 6) a bonding layer of 0.5 μm to 10 μm, 7) a PET layer of 10 μm to 150 μm, 8) a bonding layer of 0.5 μm to 10 μm, and 9) a PP layer of 0.5 μm to 150 μm.

The PP layers 9) and 1), which are the uppermost and lowermost surfaces, are laminated in the form of a film or form a functional (bonding, adhesive bonding) layer with a liquid coating.

The PP layer 9), which is the uppermost surface, is adhesively bonded to the lower surface of a coupling portion 230 of the container lid 20 including a material of PE, and the PP layer 1), which is the lowermost surface, is bonded to the upper surface 12*a* of the container inlet 12 including a material of PP and has an easy-peel function.

B) Container Lid Including a Material of PP and Container Including a Material of PP From the bottom surface, 1) a PP layer of 0.5 μm to 150 μm, 2) a bonding layer of 0.5 μm to 10 μm, 3) a PET layer of 10 μm to 150 μm, 4) a bonding layer of 0.5 μm to 10 μm, 5) a metal sheet (aluminum) layer of 6 μm to 200 μm, 6) a bonding layer of 0.5 μm to 10 μm, 7) a PET layer of 10 μm to 150 μm, 8) a bonding layer of 0.5 μm to 10 μm, and 9) a PP layer of 0.5 μm to 150 μm.

The PP layers 9) and 1), which are the uppermost and lowermost surfaces, are laminated in the form of a film or form a functional (bonding, adhesive bonding) layer with a liquid coating.

The PP layer 9), which is the uppermost surface, is adhesively bonded to the lower surface of a coupling portion 230 of the container lid 20 including a material of PP, and the PP layer 1), which is the lowermost surface, is bonded to the upper surface 12*a* of the container inlet 12 including a material of PP and has an easy-peel function.

C) Container Lid Including a Material of PE and Container Including a Material of Polyester (PET)

From the bottom surface, 1-1) an adhesive layer of 0.5 μm to 100 μm having characteristics of easy-peel, 1-2) a PET layer of 12 μm to 500 μm, 2) a bonding layer of 0.5 μm to 10 μm, 3) a PET layer of 10 μm to 150 μm, 4) a bonding layer of 0.5 μm to 10 μm, 5) a metal sheet (aluminum) layer of 6 μm to 200 μm, 6) a bonding layer of 0.5 μm to 10 μm, 7) a PET layer of 10 μm to 150 μm, 8) a bonding layer of 0.5 μm to 10 μm, and 9) a PP layer of 0.5 μm to 150 μm.

The PP layer 9), which is the uppermost surface, has an adhesive bonding function to the lower surface of a coupling portion 230 of the container lid 20 described below, and the adhesive layer having the characteristics of easy-peel is bonded to the upper surface 12*a* of the container inlet 12 including a material of PET and has an easy-peel function.

D) Container Lid Including a Material of PE and Container Including a Material of PET From the bottom surface, 1) a Co-Polyester film layer of 12 μm to 500 μm, 2) a bonding layer of 0.5 μm to 10 μm, 3) a PET layer of 10 μm to 150 μm, 4) a bonding layer of 0.5 μm to 10 μm, 5) a metal sheet (aluminum) layer of 6 μm to 200 μm, 6) a bonding layer of 0.5 μm to 10 μm, 7) a PET layer of 10 μm to 150 μm, 8) a bonding layer of 0.5 μm to 10 μm, and 9) a PP layer of 0.5 μm to 150 μm.

The PP layer 9), which is the uppermost surface, has an adhesive bonding function to the lower surface of a coupling portion 230 of the container lid 20 described below, and the Co-Polyester film layer is bonded to the upper surface 12*a* of the container inlet 12 including a material of PET and has an easy-peel function. The Co-Polyester film layer 46 is a polyester film having a thermal bonding function itself.

E) Container Lid Including a Material of PE and Container Including a Material of Polystyrene (PS)

From the bottom surface, 1) an easy-peel film layer of 12 μm to 150 μm, 2) a bonding layer of 0.5 μm to 10 μm, 3) a PET layer of 10 μm to 150 μm, 4) a bonding layer of 0.5 μm to 10 μm, 5) a metal sheet (aluminum) layer of 6 μm to 200 μm, 6) a bonding layer of 0.5 μm to 10 μm, 7) a PET layer of 10 μm to 150 μm, 8) a bonding layer of 0.5 μm to 10 μm, and 9) a PP layer of 0.5 μm to 150 μm.

The PP layer 9), which is the uppermost surface, has an adhesive bonding function to the lower surface of a coupling portion 230 of the container lid 20 described below, and the Co-Polyester film layer is bonded to the upper surface 12*a* of the container inlet 12 including a material of PS and has an easy-peel function.

F) Container Lid Including a Material of PE and Container Including a Material of PE From the bottom surface, 1) an easy-peel layer of 12 μm to 150 μm, 2) a bonding layer of 0.5 μm to 10 μm, 3) a PET layer of 10 μm to 150 μm, 4) a bonding layer of 0.5 μm to 10 μm, 5) a metal sheet (aluminum) layer of 6 μm to 200 μm, 6) a bonding layer of 0.5 μm to 10 μm, 7) a PET layer of 10 μm to 150 μm, 8) a bonding layer of 0.5 μm to 10 μm, and 9) a PP layer of 0.5 μm to 150 μm.

The PP layer 9), which is the uppermost surface, has an adhesive bonding function to the lower surface of a coupling portion 230 of the container lid 20 including a material of PE described below, and the easy-peel layer, which is the lowermost surface, is bonded to the upper surface 12*a* of the container inlet 12 including a material of PE and has an easy-peel function.

Hereinafter, each layer of the sealing member 30 is described below.

Easy-Peel Function Layer

As a method of forming a layer having an easy-peel function, there are two methods such as liquid coating and melt extrusion coating.

In the liquid coating method, a water-based or oil-based liquid material is made by combining resins such as m-PE, LDPE, HDPE, LLDPE, PP, EVA, Olefin, EAA, EMA, EMAA, EEA, and rubber, and this material is applied on the surface of a film or sheet using a gravure printing M/C (Machine), micro gravure M/C, or dry lamination M/C.

In the melt extrusion coating method, a material is extruded to have a certain thickness on a film or sheet using an extrusion laminate M/C. Resin chips, in which resins such as m-PE, LDPE, HDPE, LLDPE, PP, EVA, Olefin, EAA, EMA, EMAA, EEA, and rubber are combined, are melted at a high temperature in the range of 150 to 350° C. in the extruder and extruded while the thickness thereof is adjusted through a T-die.

Bonding Agent Layer

A bonding agent layer is made using two component-type polyurethane having excellent heat resistance, cold resistance, and water resistance, and bonding is made by laminating a film or sheet with a bonding agent using a dry lamination M/C and then curing same. The bonding agent may be composed of a main material (polyester, polyether), a hardener (isocyanate), and a solvent (MEK, EA).

PET Film Layer

This film layer is a biaxially stretched polyester film, which has excellent heat resistance and cold resistance, and has surface tension in the range of 36 to 60 dyne/cm by corona discharge treatment on both sides.

Aluminum Foil Layer (Metal Sheet Layer)

This layer is made using hard aluminum or soft aluminum, and a foil having surface tension of 60 dyne/cm or more on both sides may be used. As a material, A1000 series such as A1235 and A1100 having aluminum purity of 99% or higher may be used.

Easy-Peel Co-EX Film Layer

This film layer is a multi-layer co-extruded film, and is a functional film in which an easy-peel function is imparted to a heat bonding layer. A film in the form of multi-layer is produced by combining resins such as m-PE, LDPE, HDPE, LLDPE, PP, EVA, Olefin, EAA, EMA, EMAA, EEA, and rubber. The film may be diversely produced, from a single-layer film to a 12-layer film, depending on the type of an extruder.

Co-EX Film Layer

This film layer is a multi-layer co-extruded film and is the most commonly used for general thermal bonding. A film in the form of multi-layer is produced by combining resins such as m-PE, LDPE, HDPE, LLDPE, PP, EVA, Olefin, EAA, EMA, EMAA, EEA, and rubber. This film layer does not have an easy-peel function and is mainly used for thermal bonding. The film may be diversely produced, from a single-layer film to a 12-layer film, depending on the type of an extruder.

The upper surface of the sealing member 30 as described above is adhered to the lower surface of the coupling portion 230 of the container lid 20 by using the heat generated in the metal sheet layer due to the application of high frequency (i.e., induction method), and the bottom surface thereof is adhered to the upper surface 12*a* of the container inlet 12.

Here, the material properties of the upper and bottom surfaces of the sealing member 30 may be different from each other, and thus, the sealing member 30 may be provided with a mark for distinguishing the bottom surface and the upper surface, for example, a mark such as color, symbol, or letter.

Figure 4A:
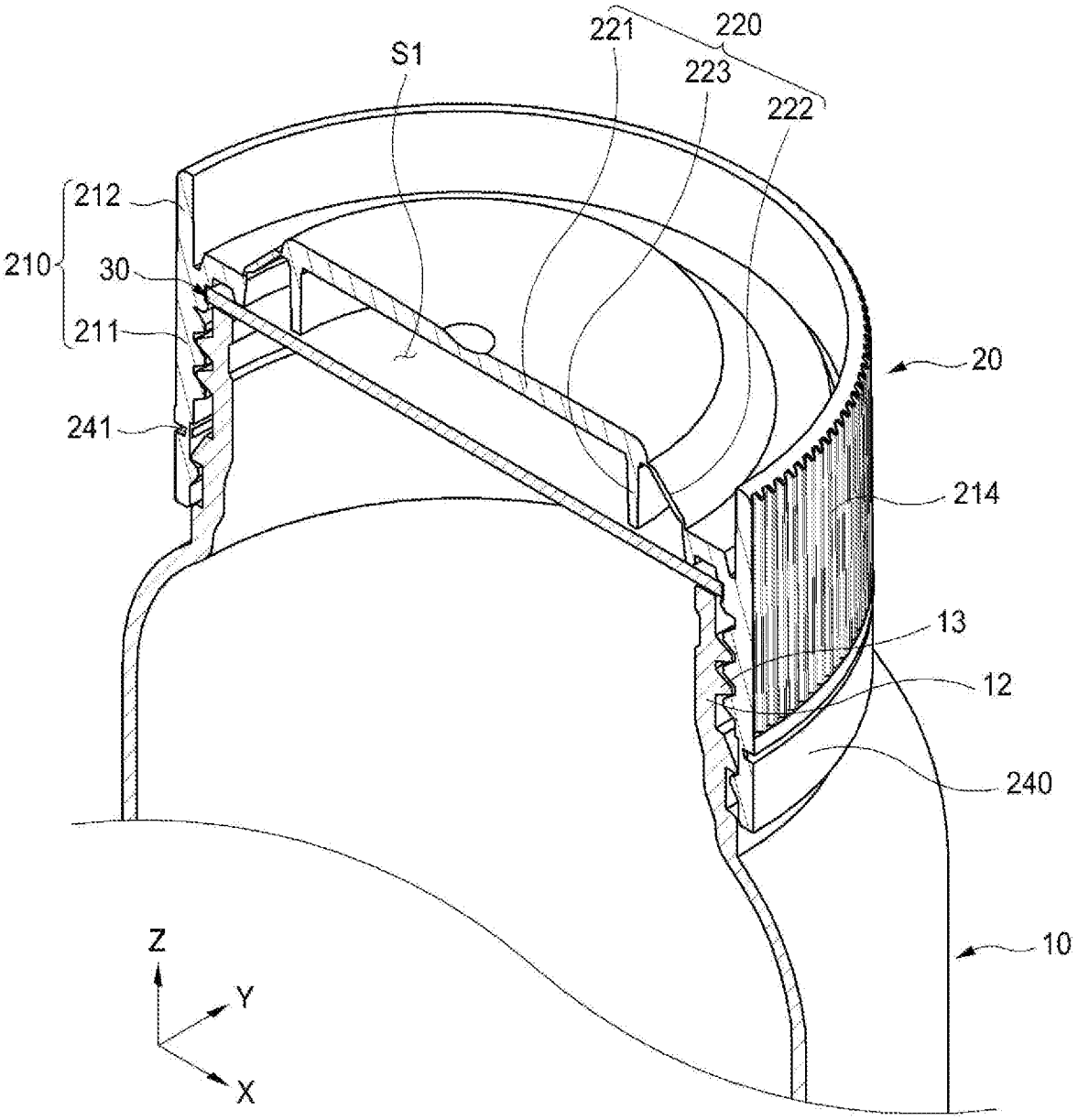
FIG. 4A is a partial cutaway perspective view of a container assembly of FIG. 3.
Figure 4B:
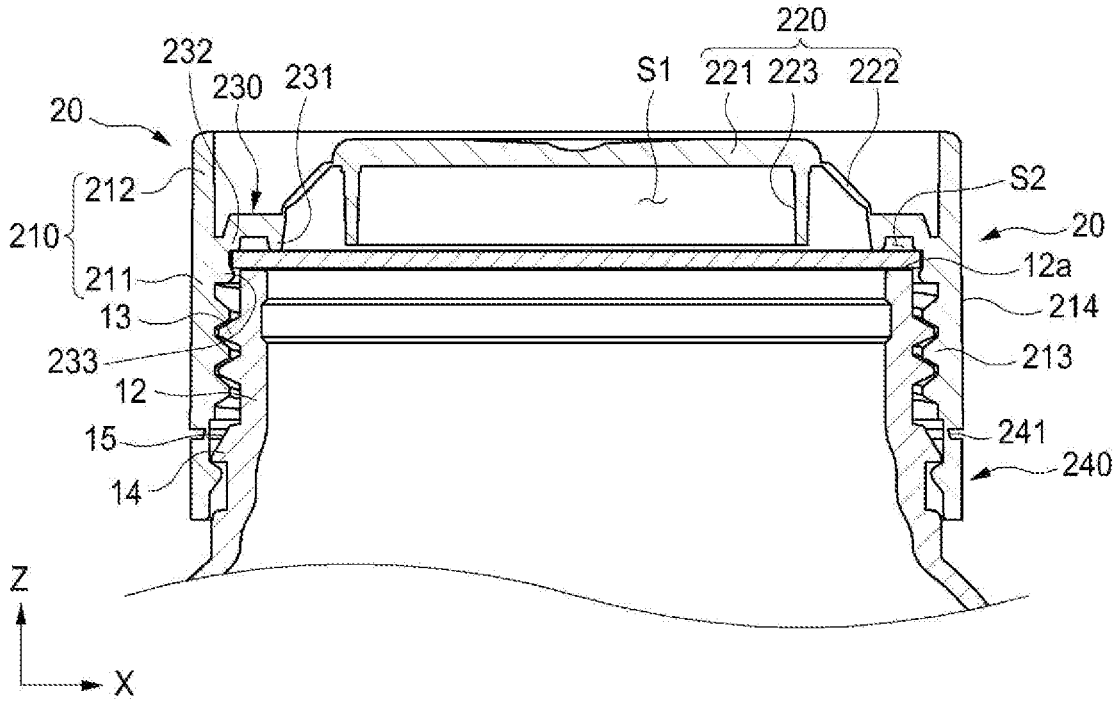
FIG. 4B is a partial cross-sectional view showing a portion of the vertical cross-sectional view illustrated in FIG. 3.
Figure 4C:
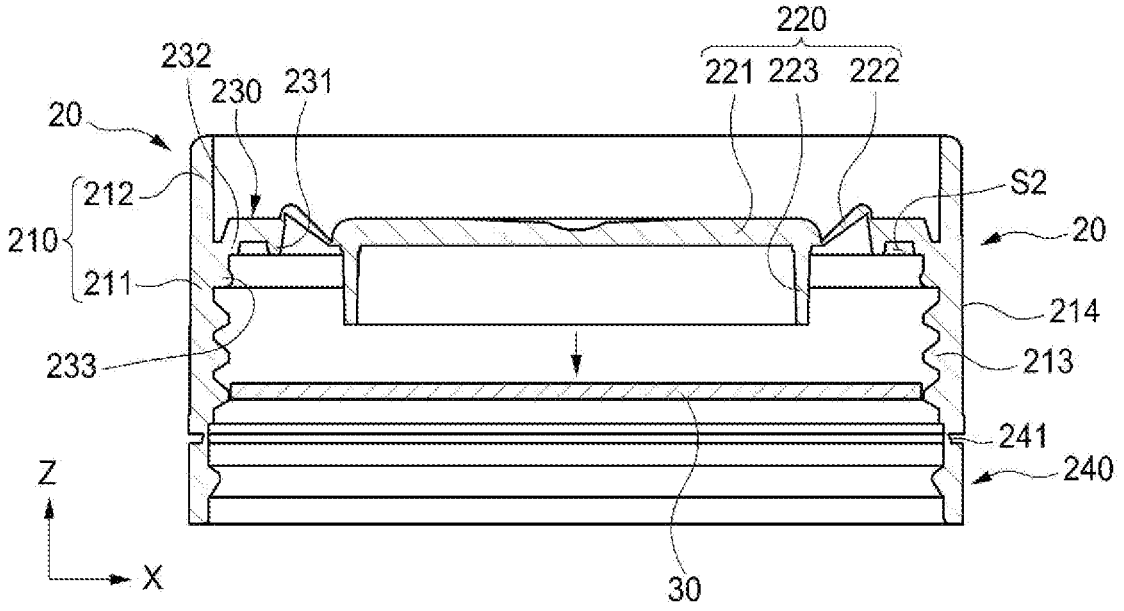
FIG. 4C is a partial cross-sectional view showing a process of removing a sealing member after a container lid is separated in FIG. 4B.
Figure 5A:
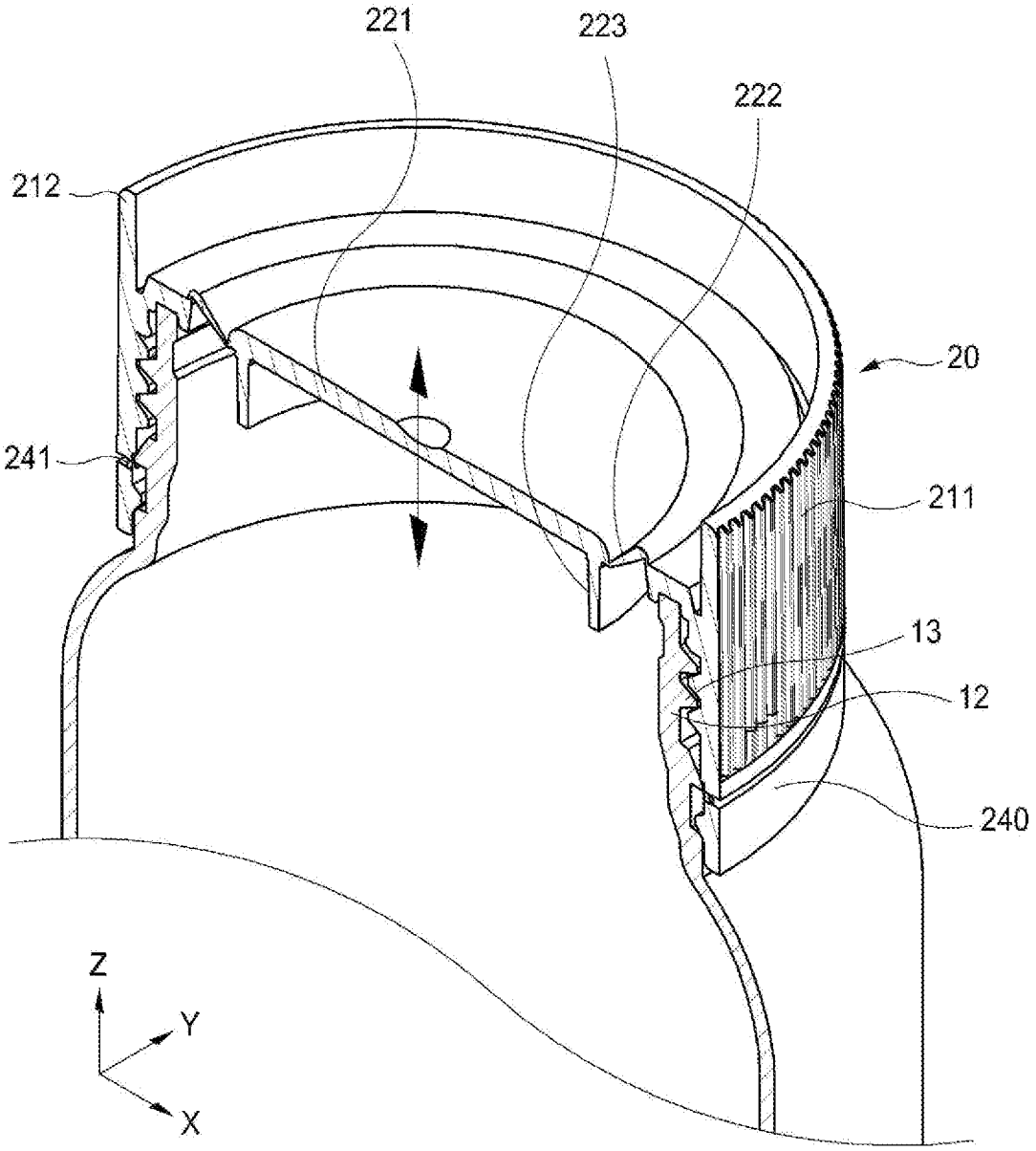
FIG. 5A is a cutaway perspective view showing that a container lid is coupled to a container in a state in which a sealing member is removed.
Figure 5B:
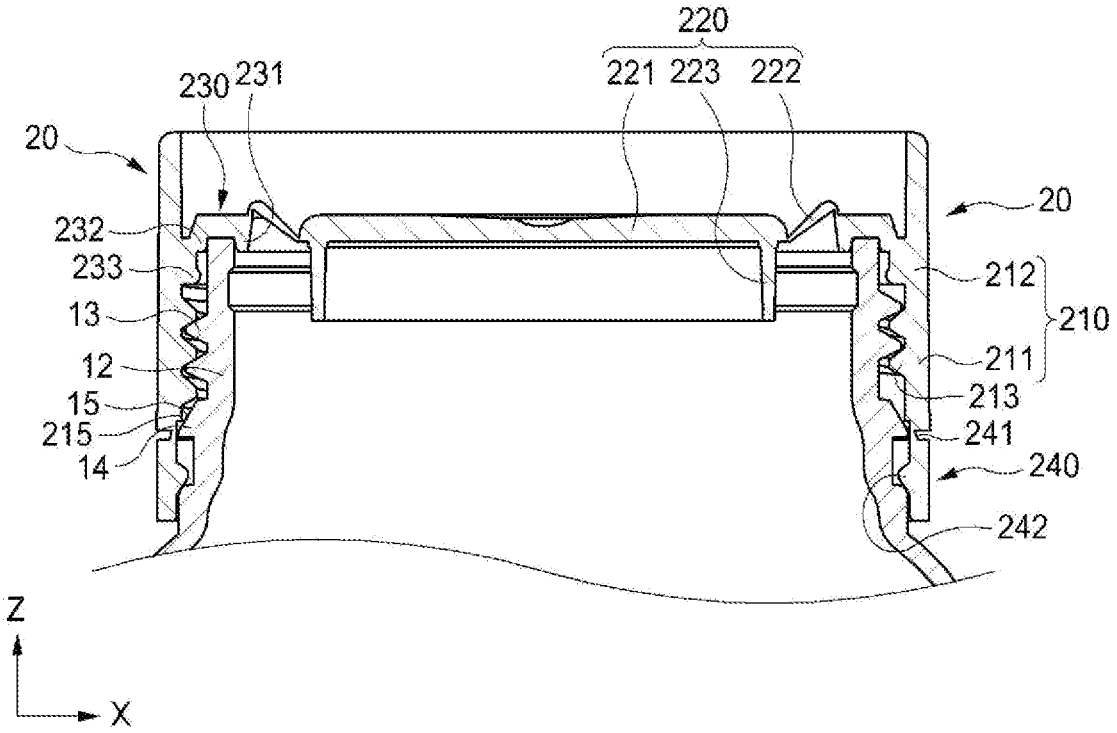
FIG. 5B is a partial cross-sectional view as a view for a different side from FIG. 5A.

Also, as illustrated in FIG. 4C, the sealing member 30 having the above configuration is removed from the container lid 20 after the container lid 20 is separated from the container inlet 12, or the sealing member may also be used while stored inside the container lid 20. For reference, although a skirt 450 is illustrated as being in an unseparated state for convenience in FIG. 4C, a bridge 451 is broken in actual use, and the skirt 450 remains at the container inlet 12.

In particular, when the sealing members 30 having the compositions suggested in A) to E) are used in a stored state inside the container lid 20, these sealing member secure some degree of bonding force to the container inlet 12, and the effect of sealing the container 10 may be maintained to some extent.

Also, considering that the sealing member 30 is coupled to the upper surface 12*a* of the container inlet 12 and the lower surface of the coupling portion 230 of the container lid 20, it is preferable that the edge 31 of the sealing member has higher rigidity than a remaining inner portion 32.

To this end, the rigidity of the sealing member 30 may be reinforced by increasing the thickness of the edge portion 31, particularly the thickness of the metal sheet layer 311, or forming the metal sheet layer with higher hardness.

In addition, in order to reinforce the rigidity at a level that does not hinder the adhesion and sealing to the upper surface 12*a* of the container inlet 12 and the lower surface of the coupling portion 230 of the container lid 20, ribs and the like may be formed on the sealing member 30. Accordingly, it is possible to reinforce the rigidity of the sealing member.

Hereinafter, embodiments of the present invention are described with reference to the drawings, focusing on the characteristics of each embodiment. The same or similar parts are omitted for convenience of description, and each embodiment is not limited to the embodiment and may be combined with each other.

The container lid 20 may include: a lid body 210 coupled to the container inlet 12; and a sealing member detacher 220 which is installed in the lid body 210 and separates the sealing member 30 from the lid body 210.

The lid body 210 is configured to be coupled to the container inlet 12 and may have various structures.

The lid body 210 may have a cylindrical shape corresponding to the planar shape of the container inlet 12.

In addition, the lid body 210 may be coupled to the container inlet 12 by various methods, for example, by various coupling such as fitting and screwing.

For example, the lid body 210 may have, on an inner circumferential surface, a female threaded portion 213 screw-coupled to a male threaded portion 13 formed at the container inlet 12, and thus may be screw-coupled with the container inlet 12.

In addition, the lid body 210 may include a partition wall portion 212, which is formed at the same or higher level than the upper surface of a push portion 221 described below on the upper side based on the coupling portion 230 described below, and a container coupling portion 211, which is coupled to the container inlet 12.

The partition wall portion 212 is a portion formed equal to or higher than the upper surface of the push portion 221 described below so that the push portion 221 described below is not arbitrarily pressed, and may have various configurations.

The container coupling portion 211 is a portion coupled to the container inlet 12 and may have various configurations depending on the coupling structure of the container inlet 12. Also, the container coupling portion may be configured to seal the inside of the container 10 before and after removal of the sealing member 30.

Also, the container coupling portion 211 may include, at the lower end, a skirt 240 connected by a plurality of bridges 241.

The skirt 240 is coupled in a state in which the container lid 20 is locked to a skirt locking portion 14 formed at the container inlet 12, and the skirt may be used to check whether the container lid 20 is initially opened by breaking the bridges 241 when the container lid 20 is initially opened.

Also, when the container lid 20 is separated from the container inlet 12 by rotation, the sealing member 30 attached to the upper end of the container inlet 12 has to be separated together. Therefore, the sealing member 30 needs to be coupled to the container lid 20.

Here, various embodiments are possible according to the coupling structure between the sealing member 30 and the container lid 20.

In an embodiment of the present invention, the upper surface of the sealing member 30 is attached to the lid body 210. To this end, the lid body 210 may include a coupling portion 230 which corresponds to a region coupled to an upper surface 12*a* of the container inlet 12 and to which an upper surface of an edge 31 of the sealing member 30 is attached.

The coupling portion 230 is configured to correspond to a region coupled to the upper surface 12*a* of the container inlet 12, and the upper surface of the edge 31 of the sealing member 30 is attached thereto. The coupling portion may have various configurations.

That is, the coupling portion 230 is formed to protrude further inward from the inner circumferential surface of the lid body 210 so as to come into close contact with the upper surface of the sealing member 30, and is integrally formed with the lid body 210.

For example, as illustrated in FIGS. 7 to 10F and FIGS. 13 and 19, the coupling portion 230 may form a flat surface to be in close contact with the upper surface of the sealing member 30.

In addition, as another example, one of the coupling portion 230 and the upper end of the container inlet 12 may have a groove, and a portion of the other one may be inserted into the groove so that the other one is inserted into and brought into close contact with the one.

Figure 3:
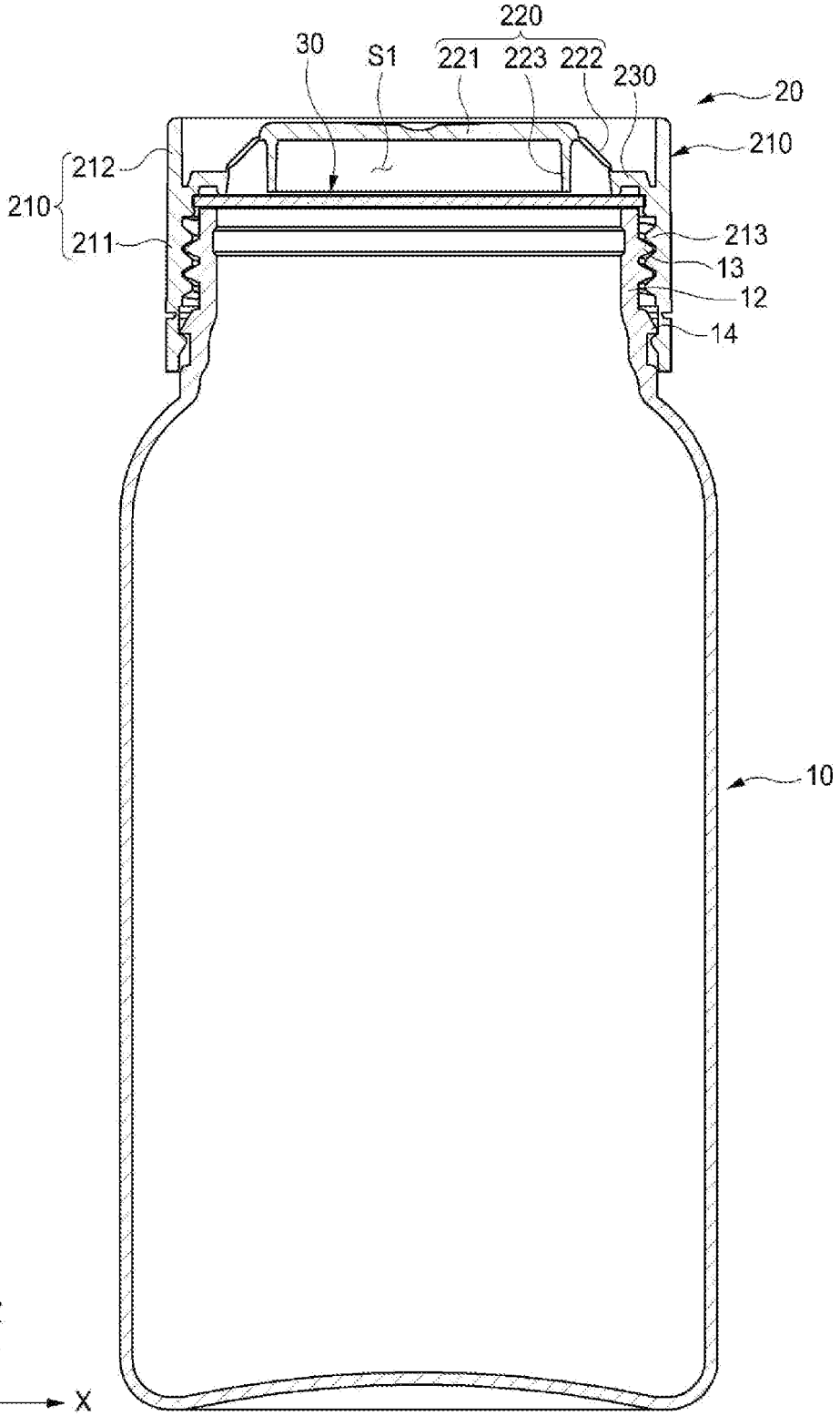
FIG. 3 is a cross-sectional view taken along line III-III of FIG. 2.

More specifically, as illustrated in FIGS. 3, 4A and 4B, the coupling portion 230 may have the groove S2 into which the upper end of the container inlet 12 is inserted.

The groove S2 is a groove into which the upper end of the container inlet 12 is inserted, and may have a circular shape corresponding to the shape of the container inlet 12 when viewed from above.

Also, for the container lid 20 having the above configuration, when the container lid 20 is coupled to the container inlet 20 after the sealing member 30 is removed, the upper end of the container inlet 12 is inserted into the groove S2.

Here, the insertion coupling between the groove S2 and the upper end of the container inlet 12 may maintain the sealed state of the container 10 by close contact with each other even though the sealing member 30 is removed (the container lid 20 has a plastic material such as PP or PET, and the close contact state is sufficiently maintained during pressing and coupling when considering the soft characteristics of plastics.).

That is, the groove S2 preferably has an inner circumferential surface that maintains a state in close contact with each other as much as possible when the upper end of the container inlet 12 is inserted.

Figure 13:
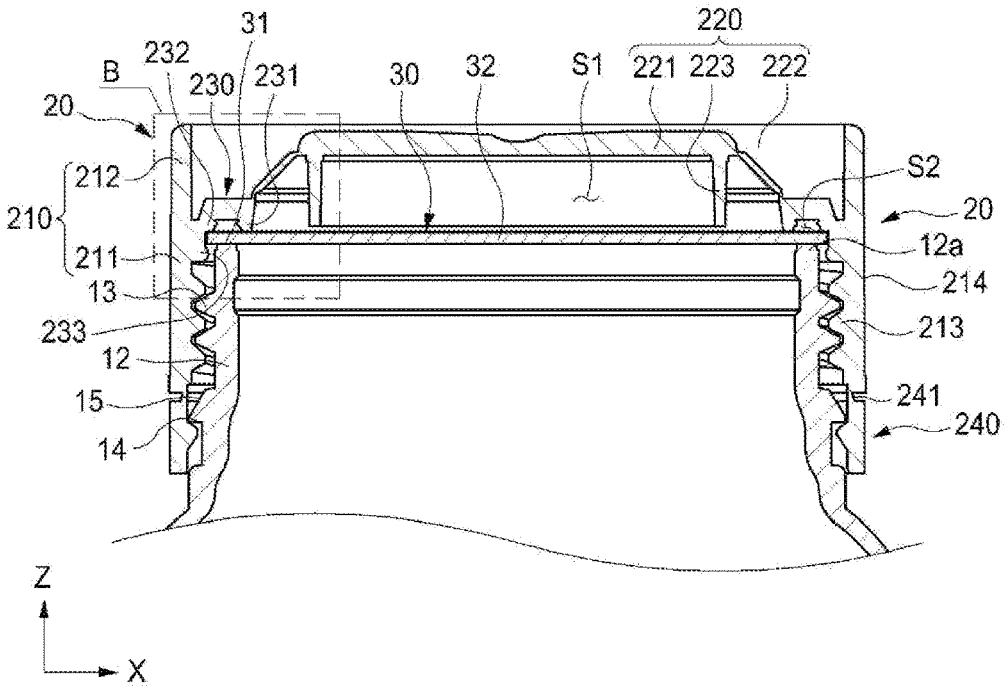
FIG. 13 is a partial cross-sectional view showing a modified example of a container assembly illustrated in FIG. 3.
Figure 14A:
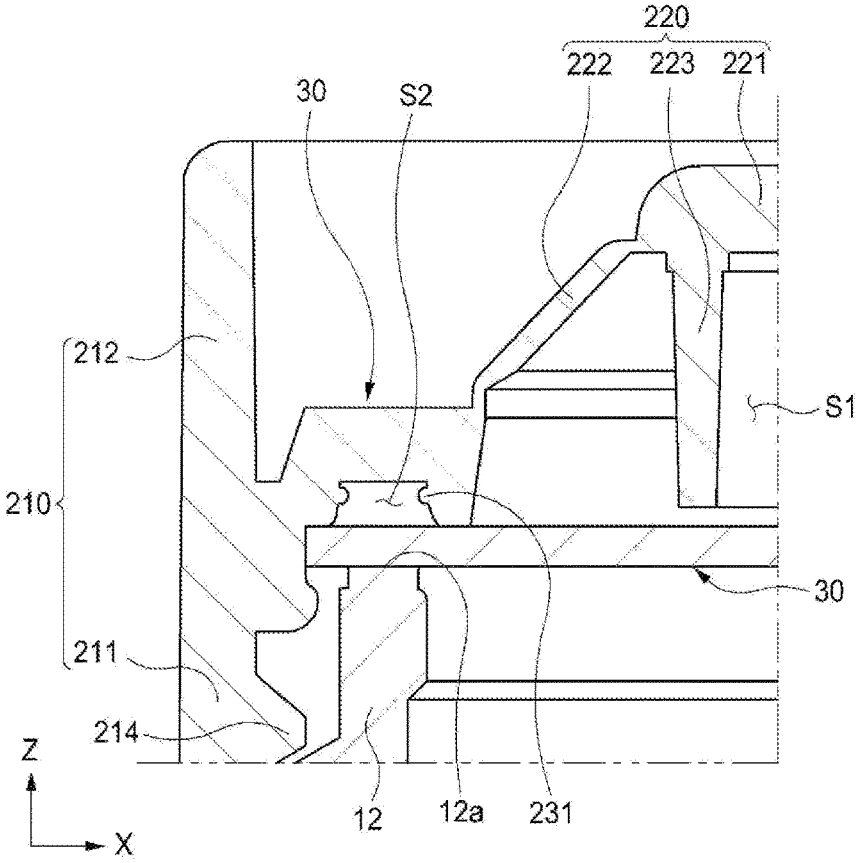
FIG. 14A is a partial enlarged cross-sectional view of a region B of FIG. 13.
Figure 14B:
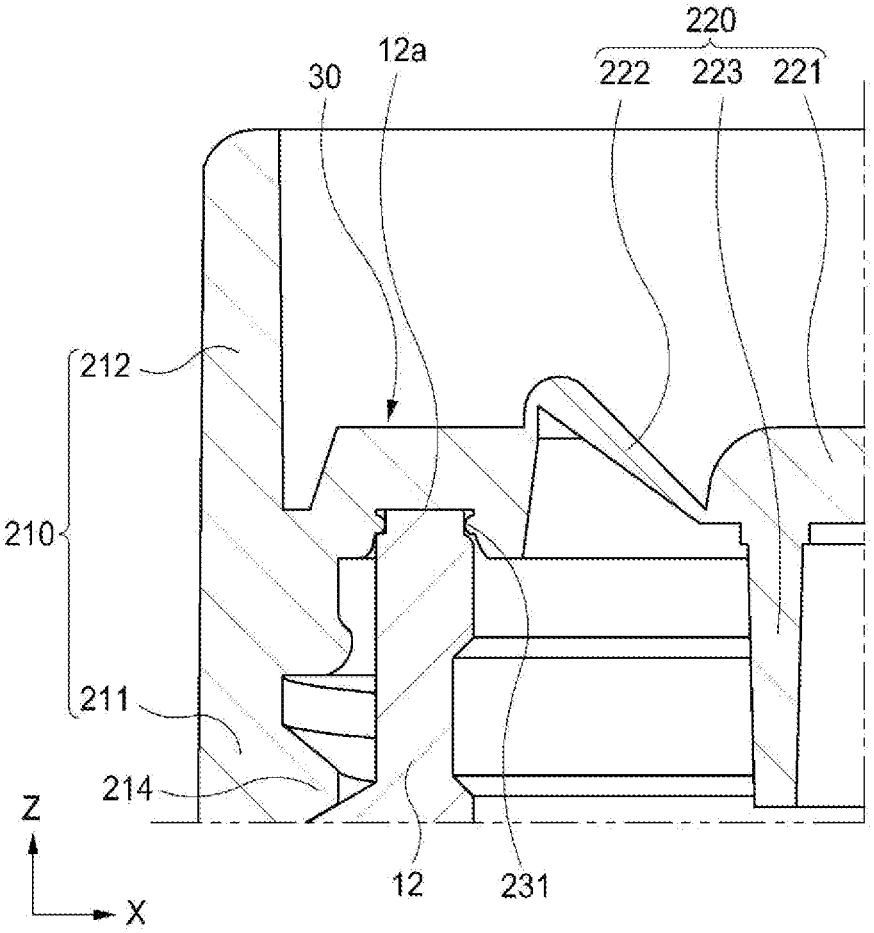
FIG. 14B is a partial cross-sectional view showing a state in which a container lid, from which a sealing member has been removed in a container assembly of FIG. 14A, is coupled to a container.

In particular, as illustrated in FIGS. 13 to 14B, one or more annular protrusions 231 protrude in the groove S2 and the upper end of the container inlet 12. Accordingly, the contact force between the groove S2 and the upper end of the container inlet 12 is increased, and thus, the container 10 may be maintained in a sealed state even when the sealing member 30 is removed.

Each of the annular protrusions 231 is a protrusion that protrudes from the inner circumferential surface of the groove S2 and has an annular shape along the circumferential direction in consideration of sealing force.

Figure 15:
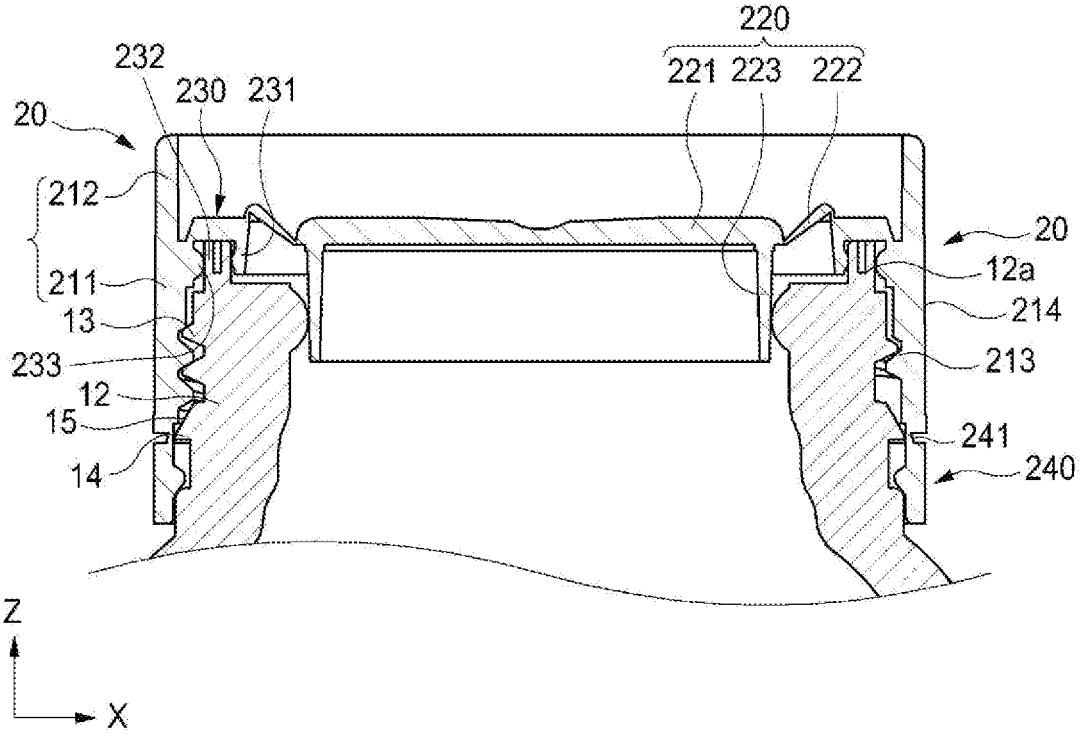
FIG. 15 is a partial cross-sectional view showing a modified example of a container assembly illustrated in FIG. 13.

Furthermore, as illustrated in FIG. 15, the upper end of the container inlet 12 may have two or more protruding portions 232 that form a plurality of concentric circles when viewed from above so that one or more grooves are formed to increase contact force when inserted into the groove S2.

The two or more protruding portions 232 are configured to form a plurality of concentric circles when viewed from above, and are deformed to increase the contact force between the groove S2 and the upper end of the container inlet 12 when inserted into the groove S2. Accordingly, the sealed state of the container 10 may be maintained even when the sealing member 30 is removed.

Also, in a coupling structure, the annular protruding portions 232 and the groove S2 may be positioned opposite to each other between the container inlet 12 and the coupling portion 230.

In addition, as a structure opposite to the annular protrusion 231 described above, one or more annular protrusions (not shown) may be formed on at least a portion of the inner and outer circumferential surfaces of a portion of the container inlet 12 inserted into the groove S2.

In addition, an upper end portion of the container inlet 12 inserted into the groove S2 may have a small radial thickness or a tapered shape in consideration of the insertion structure.

For example, the upper end portion of the container inlet 12 may have a smaller thickness in the radial direction than the lower portion thereof.

In addition, the upper end portion of the container inlet 12 may be formed sharp while going upward.

Here, the embodiment illustrated in FIG. 15 and the embodiment illustrated in FIGS. 13 to 14B may be merged with each other.

By the groove S2 and the insertion structure thereof as described above, the container lid 20 may be operated as below.

First, before initial opening, the sealing member 30 and the container lid 20 for sealing the container inlet 12 are coupled to the container inlet 12.

When a user separates the container lid 20 by rotation or snapping, the container lid 20 and the sealing member 30 are separated together from the container inlet 12 due to relative strength of adhesiveness of the sealing member 30 to the container lid 20.

After discharging contents contained in the container 10 to the outside, for example, drinking or the like, the user may seal the container 10 by coupling the container lid 20 again to the container inlet 12.

Here, the sealing member 30 may secure some degree of sealing force by the easy-peel function of the surface in contact with the container inlet 12.

Also, when the user selectively pushes the push portion 221, the sealing member 30 may be separated and removed from the container lid 20.

When the user connects the container lid 20 again to the container inlet 12 after the sealing member 30 is removed, the container 10 may be sealed by the container lid 20 coupled to the container inlet 12 as illustrated in FIGS. 4A and 4B. This sealing may be made by the above-described insertion structure between the groove S2 and the container inlet 12, that is, one or more sealing means described below.

Also, in order to ensure that the sealing member 20 separated from the container inlet 12 remains coupled to the container lid 20, the lid body 210 may include a support portion 233 protruding inward at a distance from the bottom surface of the coupling portion 230 in contact with the upper surface of the sealing member 30.

In order to ensure that the sealing member 20 separated from the container inlet 12 remains coupled to the container lid 20, the support portion 233 is configured to protrude inward from the inner circumferential surface of the lid body 210 at a distance from the bottom surface of the coupling portion 230 in contact with the upper surface of the sealing member 30 and may have various configurations.

The support portion 233 may have any shape as long as a portion of the edge of the sealing member 30 is inserted therein, and a distance to the lower surface of the coupling portion 230 in contact with the upper surface of the sealing member 30 may be substantially the same as, greater, or less than the thickness of the sealing member 30.

The sealing member detacher 220 is configured to be installed on the lid body 210 to separate the sealing member 30 from the lid body 210, and may have various configurations.

For example, as illustrated in FIGS. 2 to 6D, the sealing member detacher 220 may include: a push portion 221 which moves downward, presses the sealing member 30, and separates the sealing member 30 from the lid body 210; and a connection portion 222 which connects the lid body 210 and the push portion 221 to each other such that the push portion 221 is moved downward by elastic deformation.

The push portion 221 is configured to move downward, press the sealing member 30, and separate the sealing member 30 from the lid body 210, and may have any configuration as long as the push portion is installed on the lid body 210 so as to be movable downward.

For example, the shape of the push portion 221 on a plan view may have various shapes such as a circular shape, an elliptical shape, a rectangular shape, and a star shape.

Also, the push portion 221 may have various functions depending on the structure of the connection portion 222, such as maintaining a lowered state when pushed by a user or returning to an original position due to elasticity.

Also, the push portion 221 may have, on a bottom surface, one or more pressing portions 223 that press the sealing member 30.

The pressing portions 223 are configured to press the sealing member 30 by the downward movement of the push portion 221, and one or more pressing portions may be formed.

The pressing portions 223 may have any configuration as long as the pressing portions press the sealing member 30.

Figure 6A:
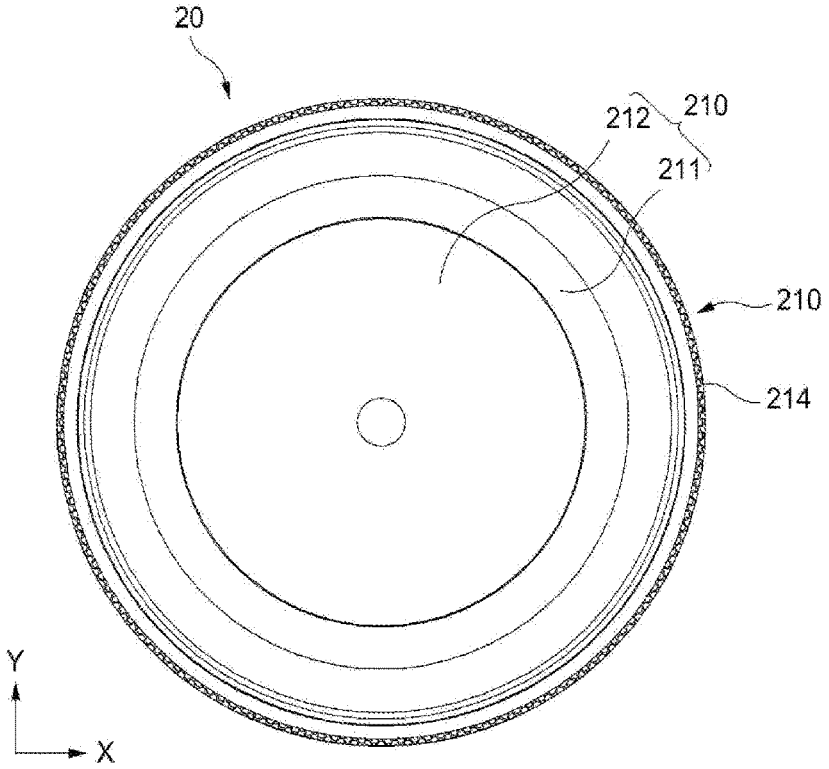
FIG. 6A is a plan view of a container lid of FIG. 2.
Figure 6B:
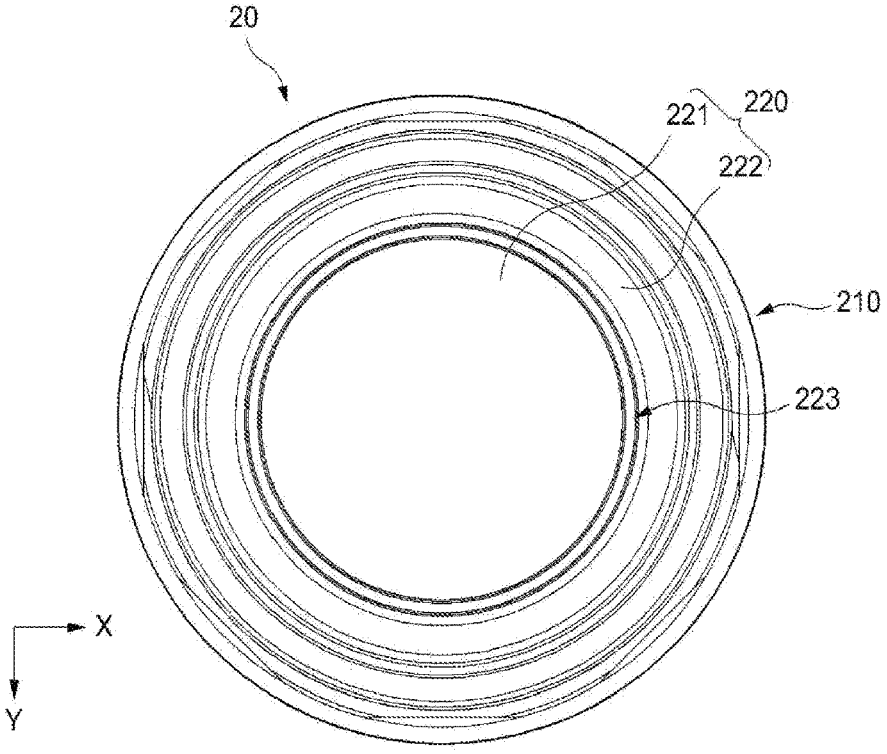
FIG. 6B is a bottom view thereof.
Figure 6C:
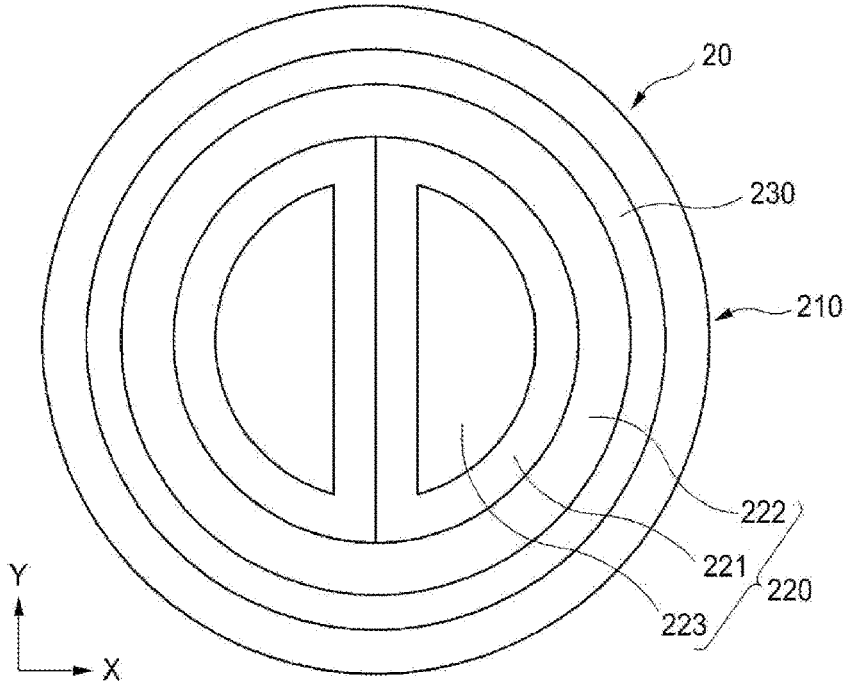
FIG. 6C is a bottom view showing a modified example of FIG. 6B.
Figure 6D:
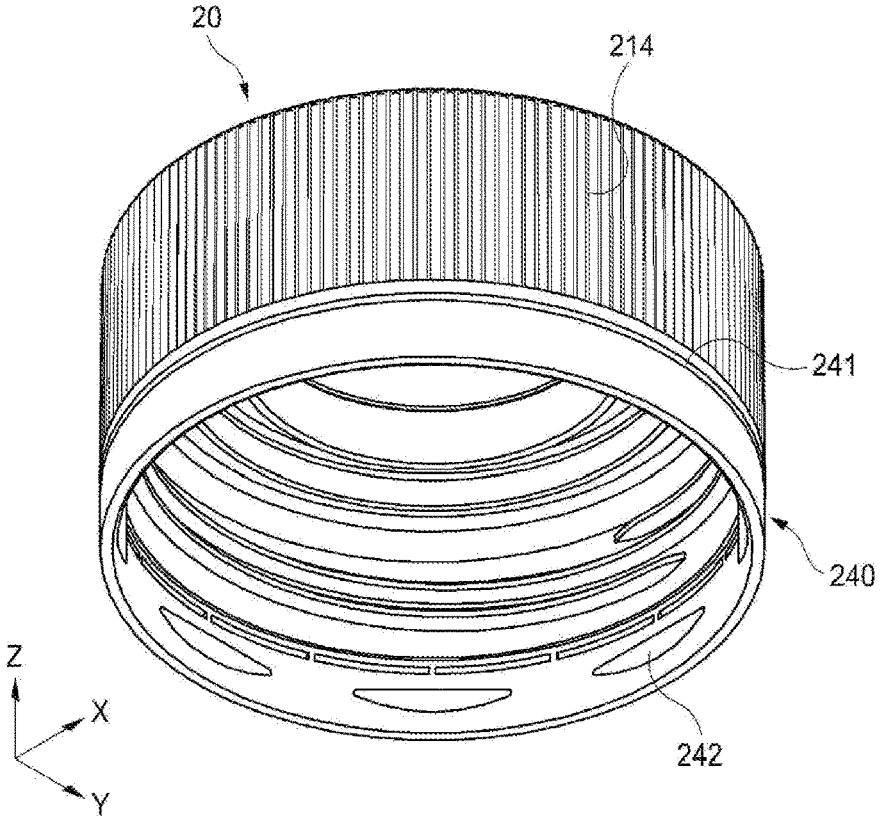
FIG. 6D is a perspective view of the container lid of the FIG. 2.
Figure 7:
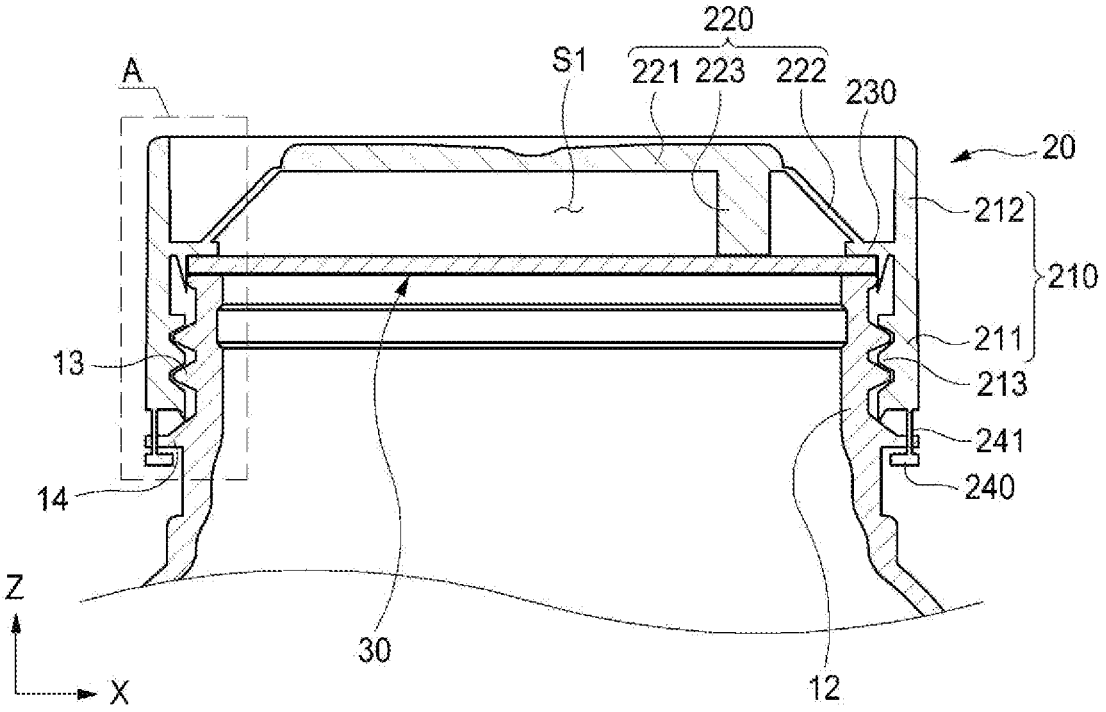
FIG. 7 is a partial cross-sectional view showing a modified example of a container assembly illustrated in FIG. 3.
Figure 8:
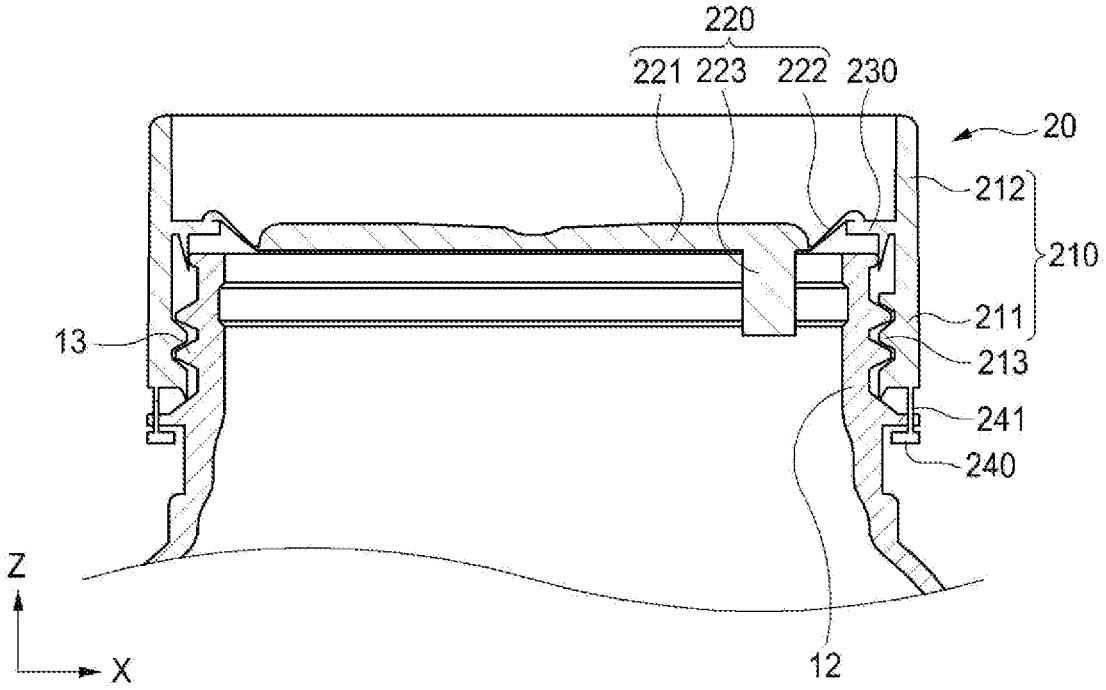
FIG. 8 is a partial cross-sectional view showing a state in which a container lid, from which a sealing member has been removed in a container assembly of FIG. 7, is coupled to a container.

For example, each of the pressing portions 223 may have a ring shape as illustrated in FIG. 6B or a semicircular shape as illustrated in FIG. 6C, when viewed in a plan view.

Also, as another example, the pressing portion 223 may have various shapes according to the shape of the push portion 221 on a plane view, as illustrated in FIGS. 18A to 18D.

For example, the push portion 221 may be formed to be eccentric from the center of the container lid 20, and in this case, the pressing portion 223 may also have various structures depending on the position and shape of the push portion 221.

As illustrated in FIG. 18A, when the push portion 221 has a circular shape eccentric from the center of the container lid 20, the pressing portion 223 may have various shapes on a plan view, such as a circular shape and a quadrangular shape.

As illustrated in FIGS. 18B and 18C, when the push portion 221 has an elliptical shape eccentric from the center of the container lid 20, the pressing portion 223 may have various shapes on a plan view, such as a circular shape, an elliptical shape, and a quadrangular shape.

As illustrated in FIG. 18C, when the push portion 221 has a semicircular shape eccentric from the center of the container lid 20, the pressing portion 223 may have various shapes on a plan view, such as a circular shape, a semicircular shape, an elliptical shape, and a quadrangular shape.

The connection portion 222 may be configured to connect the lid body 210 and the push portion 221 to each other so that the push portion 221 is moved downward by the elastic deformation, and may have various configurations.

In particular, it is preferable that the connection portion 222 is integrally formed with the push portion 221 and the lid body 210.

Furthermore, it is preferable that the connection portion 222 maintains a vertical movement state, such as being restored to its original state after the push portion 221 is lowered. To this end, the connection portion may have various structures such as a thin film and a bellows structure.

Also, as illustrated in FIG. 3, the connection portion 222, together with the push portion 221, may be formed to isolate upper and lower regions of the lid body 210 from each other.

That is, it is preferable that the entire container lid 20 is formed by injection molding, and it is preferable that the sealing member detacher 220 is integrally formed with the lid body 210 such that the container 10 is sealed when the lid body 210 is coupled to the container inlet 12.

Here, a sealed auxiliary space S1 is formed in a state in which the sealing member 30 is coupled to the container lid 20, and the auxiliary space S1 may contain auxiliary substances that may be drunk together when drinking.

The auxiliary substances may include any material that may be contained in the auxiliary space S1, such as a granular material, a powder material, and a liquid material.

Figure 12A:
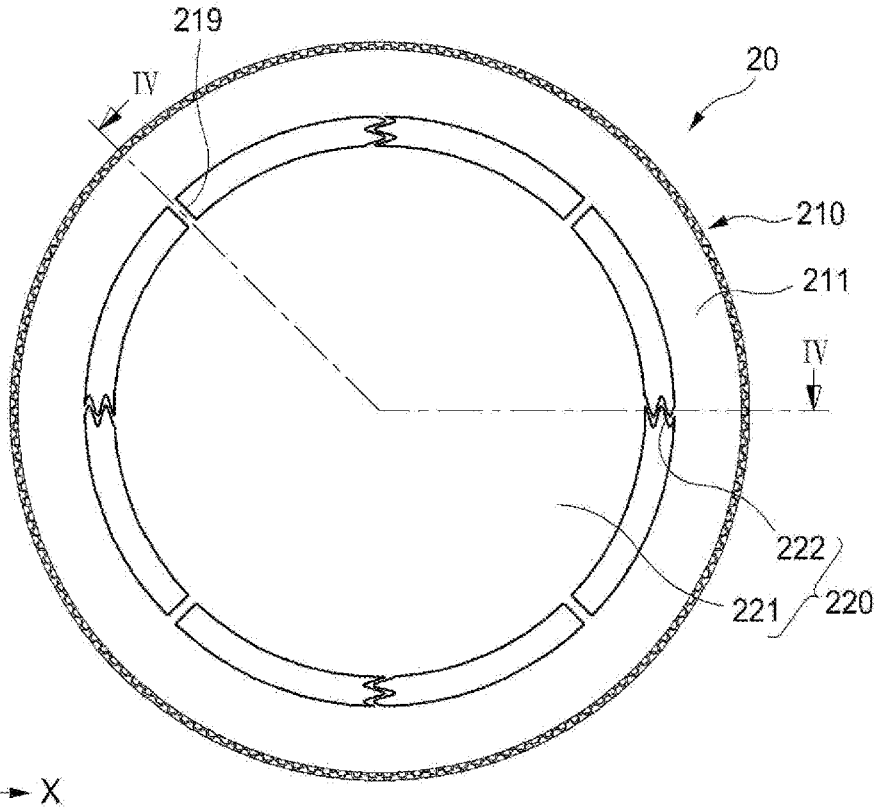
FIG. 12A is a plan view showing a modified example of a container assembly illustrated in FIG. 3.
Figure 12B:
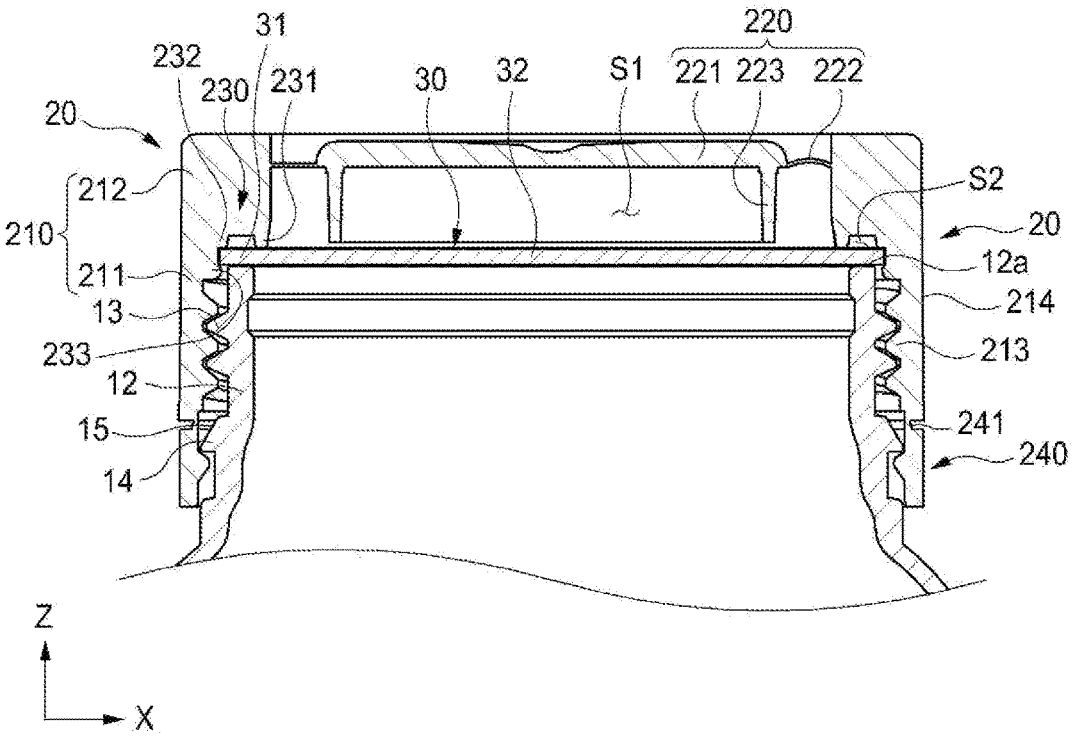
FIG. 12B is a partial cross-sectional view taken along line VI-VI of FIG. 12A.

Also, as illustrated in FIGS. 12A and 12B, the connection portion 222 may have a plurality of bands that are elastically deformable between the inner circumference of the lid body 210 and the push portion 221.

Here, the connection portion 222 may not establish a seal in the vertical direction of the container lid 20, and thus, it is preferable that the sealing member 30 remains coupled to the container lid 30.

Also, when the connection portion 222 includes a plurality of bands, various configurations such as a zigzag structure and a wire structure are possible.

In addition, one or more bridges 219 installed in the circumferential direction may be formed between the inner circumference of the lid body 210 and the push portion 221 to check whether or not the push portion 221 is initially lowered.

The bridges 219 are configured to be installed in the circumferential direction to check whether or not the push portion 221 is initially lowered, and have thin bands that connect the inner circumference of the lid body 210 and the push portion 221 to each other. Here, it is preferable that the connection portion 222 is elastically deformable so that the push portion 221 is lowered, and the bridges 219 are preferably formed to be broken when the push portion 221 is lowered.

Also, the container assembly having the above configuration may be used through the following process.

First, according to the type of contents contained in the container 10, such as beverages, alcoholic beverages, engine oil, antifreeze, cooking oil, and dairy products, the container lid is coupled to the container 10 in a state in which the sealing member 30 is inserted into the container lid 20.

Then, through application of high frequency, that is, induction, the sealing member 30 is adhered to the coupling portion 230 of the container lid 20 and the upper surface 12*a* of the container inlet 12 to thereby seal the container 10.

The container assembly distributed on a market through the above process is used when a user separates the container lid 20 from the container 10.

Here, when the container lid 20 is separated from the container 10, the adhesiveness of the sealing member 30 to the container lid 20 is greater than the adhesiveness thereof to the container inlet 12. Accordingly, with the separation of the container lid 20, the sealing member 30 is also separated from the container inlet 12.

As the sealing member 30 is separated together when the container lid 20 is separated, a user tilts the container 10 and may drink or use the contents according to the purpose.

Also, the user may repeatedly use the contents contained in the container 10 other than using the contents once, and in this case, the container 10 is sealed by coupling the container lid 20 to the container 10.

Here, according to the configuration of the sealing member 30, the sealing member provides a sufficient sealing force to the container 10 when coupled again to the container 10 while being coupled to the container lid 20. Accordingly, the container 10 may be effectively sealed.

In addition, the container assembly according to the present invention provides sufficient sealing force of the container lid 20 to the container 10 by means of the structure described above, even when the sealing member 20 is removed from the container lid 20.

Furthermore, the container assembly according to the present invention may provide sufficient sealing force of the container lid 20 to the container 10, even when the sealing member 20 is removed from the container lid 20 as below.

The inner circumferential surface of the container inlet 12, the upper end portion of the container inlet 12, and the outer circumferential surface of the container inlet 12 may serve as a part for providing the sufficient sealing force of the container lid 20 to the container 10. In FIGS. 10A to 10F, FIGS. 10A to 10C are cross-sectional views before a sealing member is removed, and FIGS. 10D to 10F are cross-sectional views after a sealing member is removed.

As a first example, a sealing means is provided at the upper end portion of the container inlet 12, and thus, a sufficient sealing force of the container lid 20 to the container 10 may be provided when the container lid 20 is coupled to the container inlet 12.

Specifically, as described with reference to FIGS. 3 and 4A to 5B, one of the coupling portion 230 and the upper end of the container inlet 12 may have a groove, and a portion of the other one may be inserted into the groove so that the other one is inserted into and brought into close contact with the one.

Also, as illustrated in FIGS. 10D to 10F, an annular protrusion 234 may be formed on the bottom surface of the coupling portion 230, and a recess groove 235, into which the annular protrusion 234 is inserted, may be formed on the upper surface 12*a* of the container inlet 12.

Here, the bottom surface of the annular protrusion 234 and the upper surface 12*a* of the container inlet 12 remain adhered to the upper and bottom surfaces of the sealing member 30, respectively. When the container lid 20 is coupled to the container inlet 12 after the sealing member 30 is removed, the annular protrusion 234 may be inserted into the recess groove 235 to seal the inside of the container 10.

As a second example, a sealing means is provided on the inner circumferential surface of the container inlet 12, and thus, a sufficient sealing force of the container lid 20 to the container 10 may be provided when the container lid 20 is coupled to the container inlet 12.

A sealing means is provided on the container lid 20, in particular, on any one of the bottom surface of the connection portion 222, the push portion 221, and the pressing portion 223 and is brought into close contact with the inner circumferential surface of the container inlet 12. Accordingly, when the container lid 20 is coupled to the container inlet 12, it is possible to provide the sufficient sealing force of the container lid 20 to the container 10.

Here, one or more protruding portions 274 further protruding inward may be formed on the inner circumferential surface of the container inlet 12 to increase the sealing force.

Each of the protruding portions 274 is a portion formed to provide sufficient sealing force of the container lid 20 to the container 10 by contact with any one of the bottom surface of the connection portion 222, the push portion 221, and the pressing portion 223, and the protruding portion preferably has a ring shape.

Also, the protruding portion 274 is formed by a combination of concave and convex, and preferably forms a curved surface to maintain a close state.

In addition, the upper surface of the protruding portion 274 extends further inward and may be utilized as a surface that is adhered to the lower surface of the sealing member 30 described above.

Also, as illustrated in FIGS. 10D, 10E, and 10F, any one of the bottom surface of the connection portion 222, the push portion 221, and the pressing portion 223 is preferably provided in the form of an annular band 264 for close contact with the protruding portion 274.

Also, in order to increase contact force with the protruding portion 274, the annular band 264 preferably has an inclined surface so as to adhere more closely to the protruding portion 274 when descending.

In addition, instead of the annular band 264 being formed separately on any one of the bottom surface of the connection portion 222, the push portion 221, and the pressing portion 223, the pressing portion 223 may perform the function thereof as illustrated in FIG. 15.

Also, as a portion of the pressing portion 223, the annular band 264 may protrude separately from the side surface.

As a third example, a sealing means is provided on the outer circumferential surface of the container inlet 12, and thus, a sufficient sealing force of the container lid 20 to the container 10 may be provided when the container lid 20 is coupled to the container inlet 12.

As illustrated in FIGS. 10A, 10D, 10E, and 10F, an inclined surface 262 inclined upward is formed on the outer circumferential surface of the upper end portion of the container inlet 12, and one or more close-sealing portions 251 in close contact with the inclined surface 262 are formed on the container lid 20. Accordingly, it is possible to provide the sufficient sealing force of the container lid 20 to the container 10.

The inclined surface 262 is a surface inclined upward on the outer circumferential surface of the upper end portion of the container inlet 12, and may have a flat surface, a curved surface, or the like.

Figure 10A:
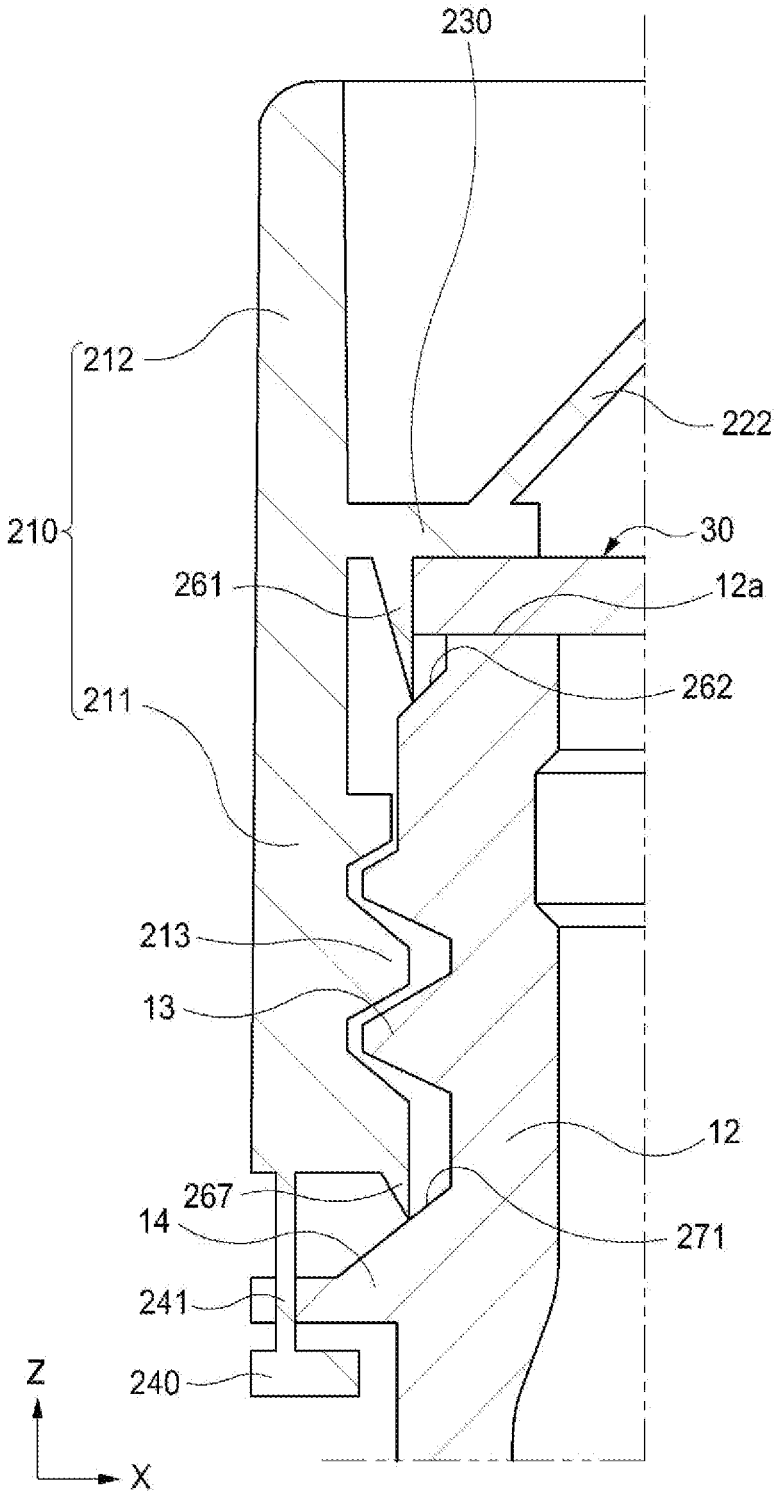
FIGS. 10A to 10F are partial cross-sectional views showing modified examples of FIG. 9.
Figure 10B:
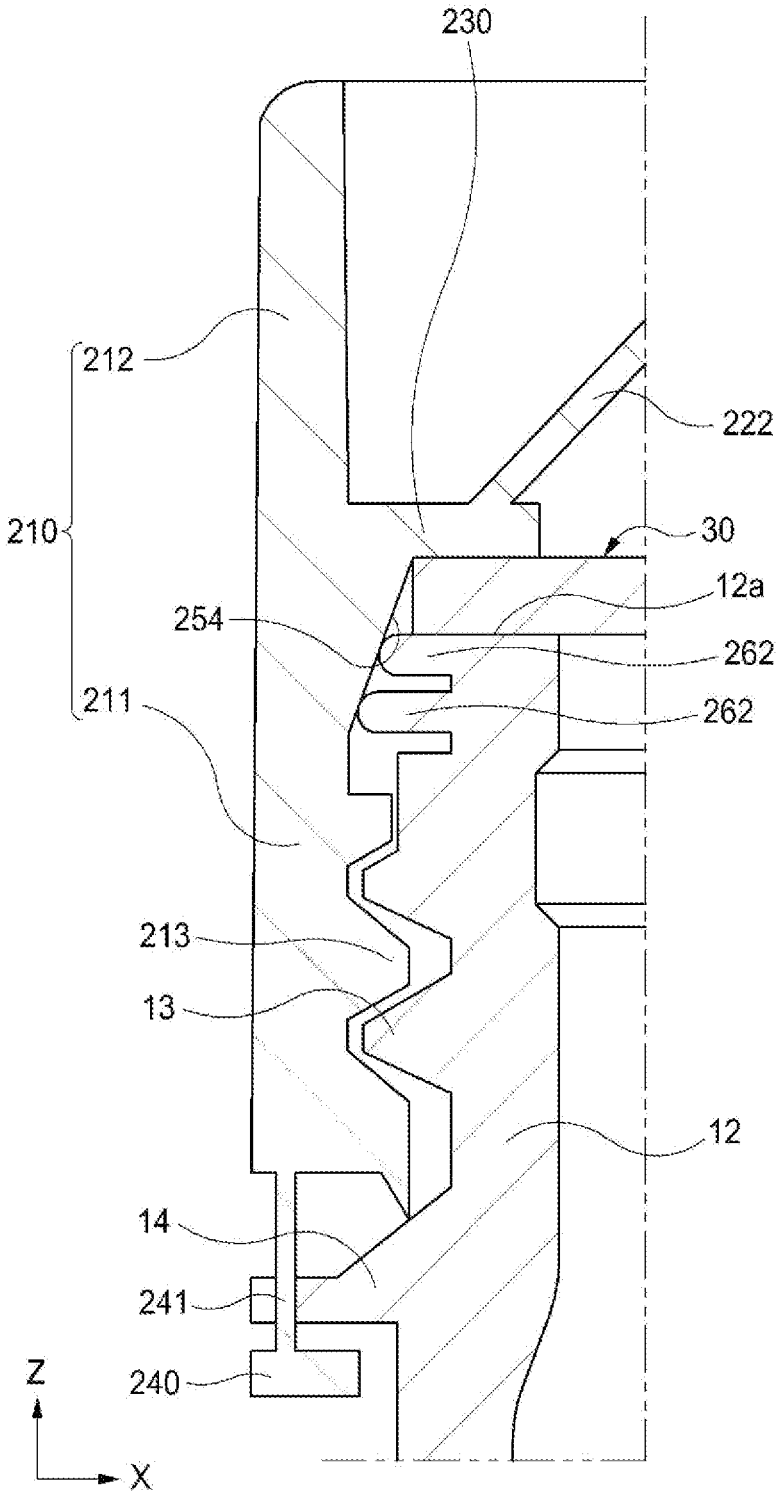
Figure 10C:
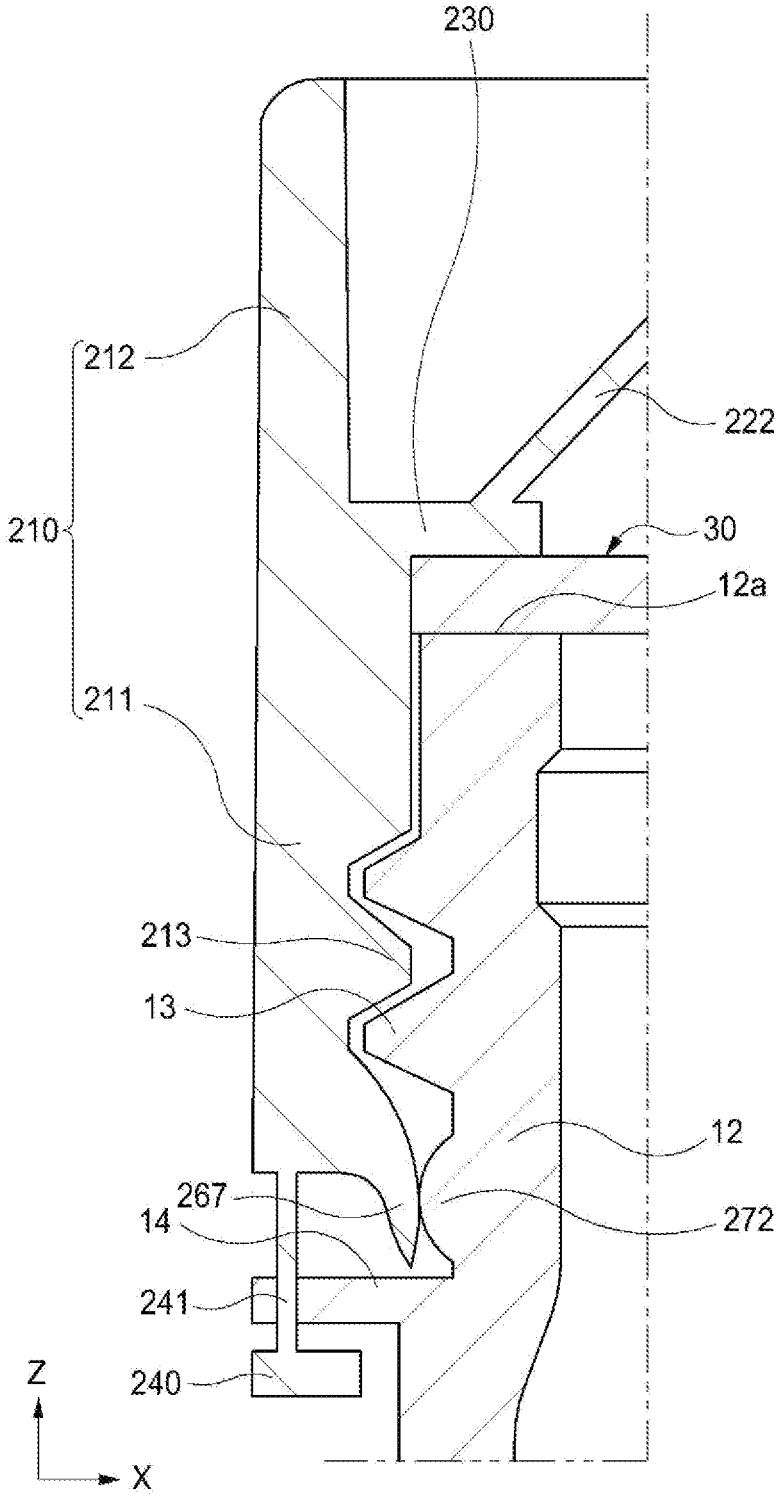
Figure 10D:
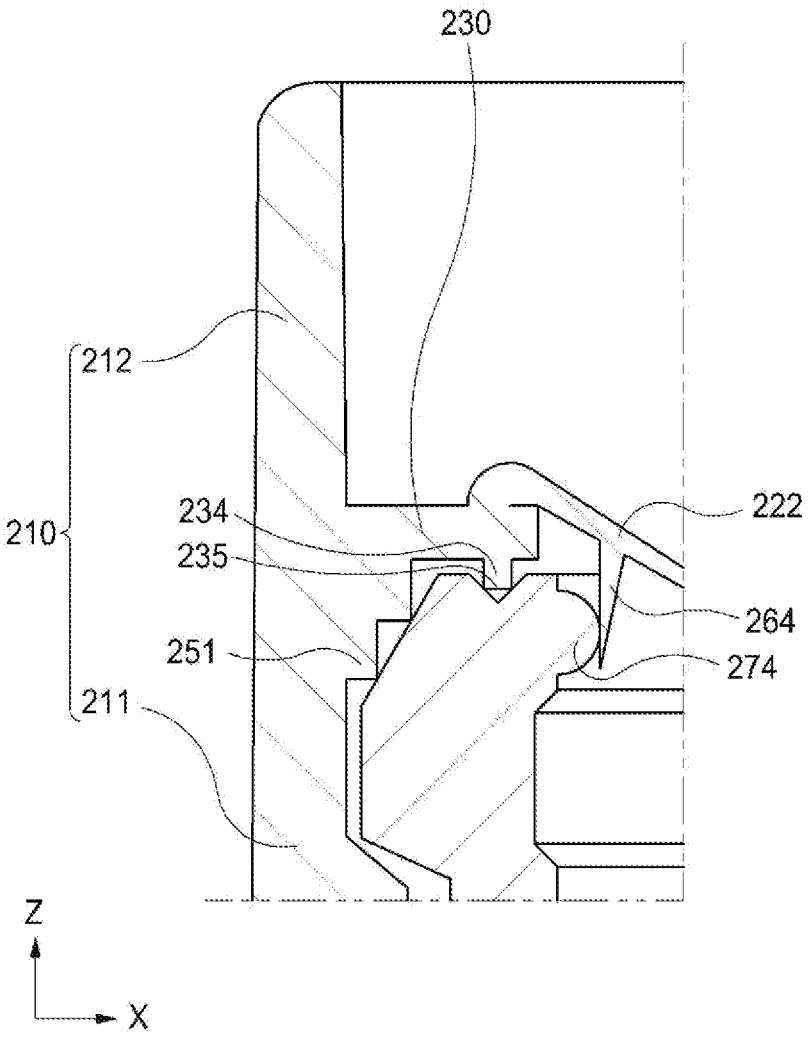
Figure 10E:
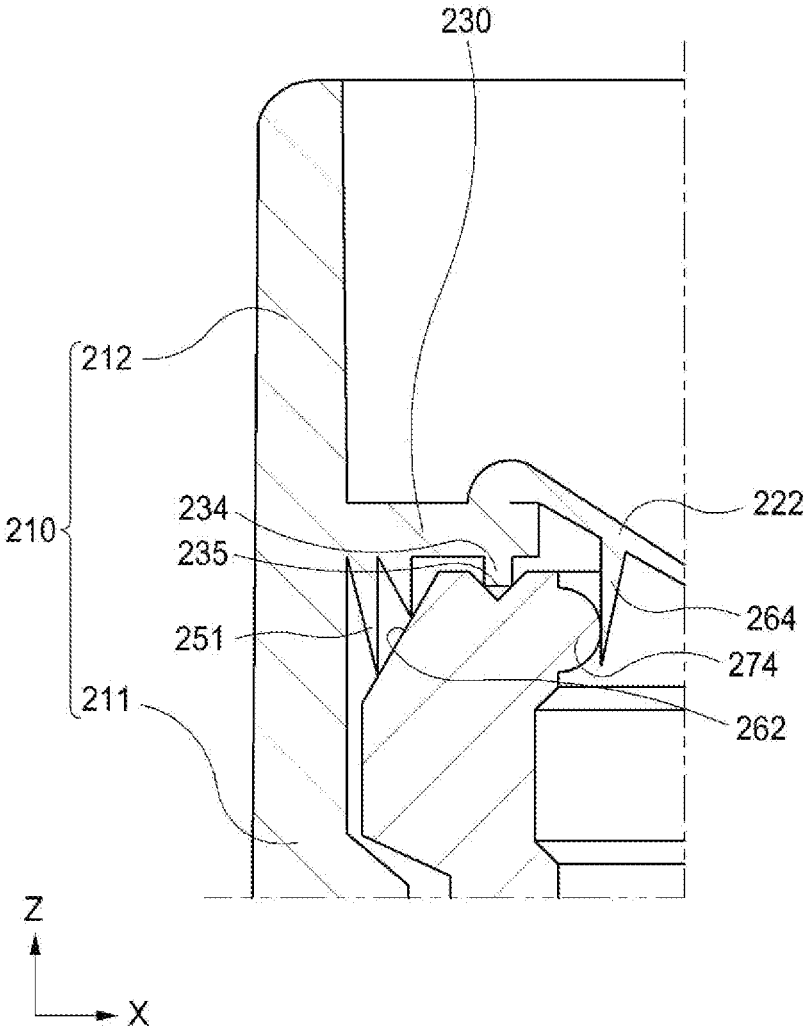
Figure 10F:
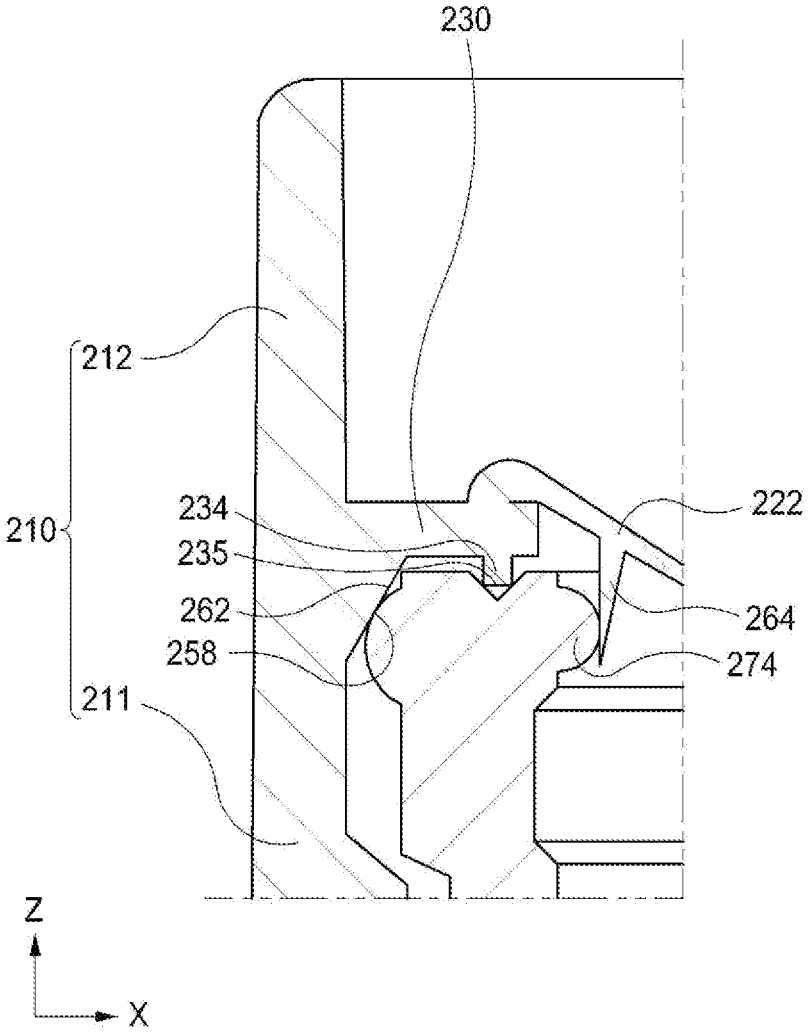
Figure 11A:
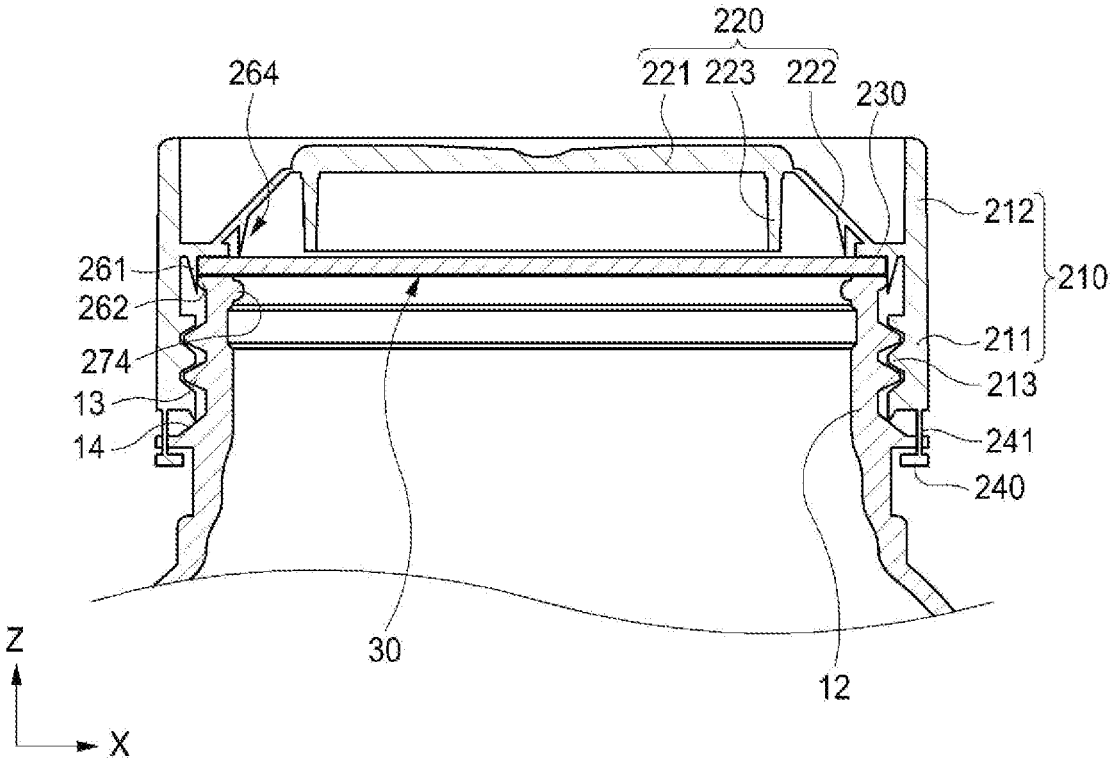
FIG. 11A is a partial cross-sectional view showing a modified example of a container assembly illustrated in FIG. 3.
Figure 11B:
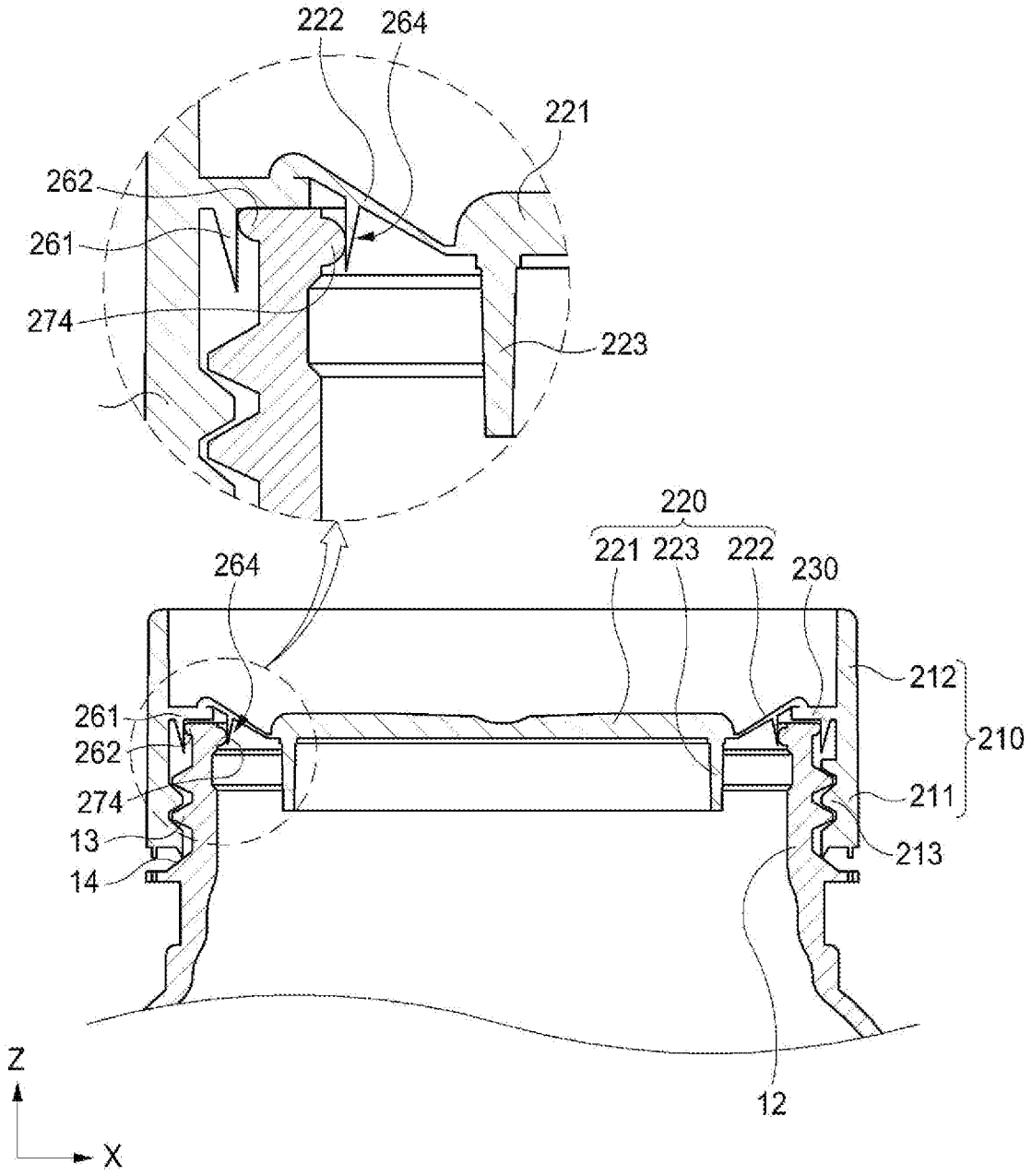
FIG. 11B is a partial cross-sectional view showing a state in which a container lid, from which a sealing member has been removed in a container assembly of FIG. 11A, is coupled to a container.

As illustrated in FIGS. 10A, 10D, and 10E, each of the close-sealing portions 251 is a portion that is in close contact with the inclined surface 262, and this portion may be formed to protrude from the container lid 20, for example, from the bottom surface of the coupling portion 230 and/or the inner circumferential surface of the container coupling portion 211.

The shape of the close-sealing portions 251 may have various shapes such as a band shape (a straight shape, a pointed shape, etc. on the cross-section), and a stair shape as illustrated in FIG. 10D.

One or more close-sealing portions 251 in close contact with the inclined surface 262 are formed on the container lid 20, and thus, it is possible to provide the sufficient sealing force of the container lid 20 to the container 10.

In addition, as illustrated in FIG. 10F, the close-sealing portions 251 may also be formed as an inclined surface 258 that is brought into close contact with the inclined surface 262.

Figure 9:
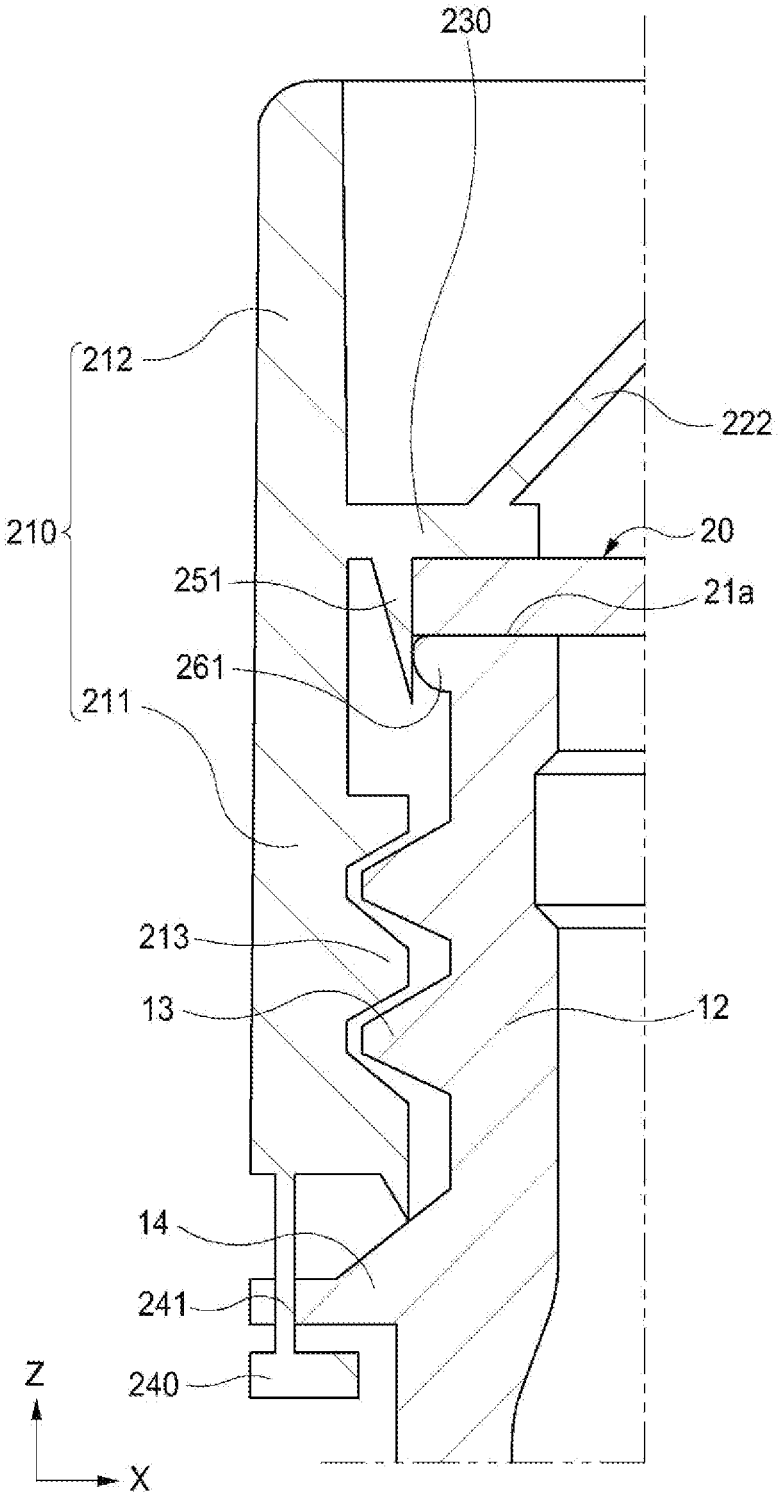
FIG. 9 is a partial enlarged cross-sectional view of a region A of FIG. 7.

In a method different from the method of forming the inclined surface 262, one or more annular outer protruding portions 261 and 262 may be formed on the outer circumferential surface of the container inlet 12 as illustrated in FIGS. 9, 10A, and 10B.

The outer protruding portions 261 and 262 are formed by protruding outward from the outer circumferential surface of the container inlet 12, and protrude to the extent that the container lid 20 does not interfere with the container inlet 12.

Also, when the two outer protruding portions 261 are formed, the degree of protrusion from the outer circumferential surface of the container inlet 12 may increase from the upper side to the lower side, by considering the descent when the container lid 20 is coupled to the container inlet 12.

Also, as illustrated in FIGS. 9, 10A, and 10B, the close-sealing portion 251 in close contact with the outer protruding portions 261 and 262 is a portion that is in close contact with the outer protruding portion 261, and this portion may be formed to protrude from the container lid 20, for example, from the bottom surface of the coupling portion 230, the support portion 233, and/or the container coupling portion 211.

Also, in establishing a seal in close contact with the outer protruding portions 261 and 262, an inclined surface 254 may be formed on the container lid 20, for example, on the bottom surface of the coupling portion 230, the support portion 233, and/or the container coupling portion 211.

Figure 21:
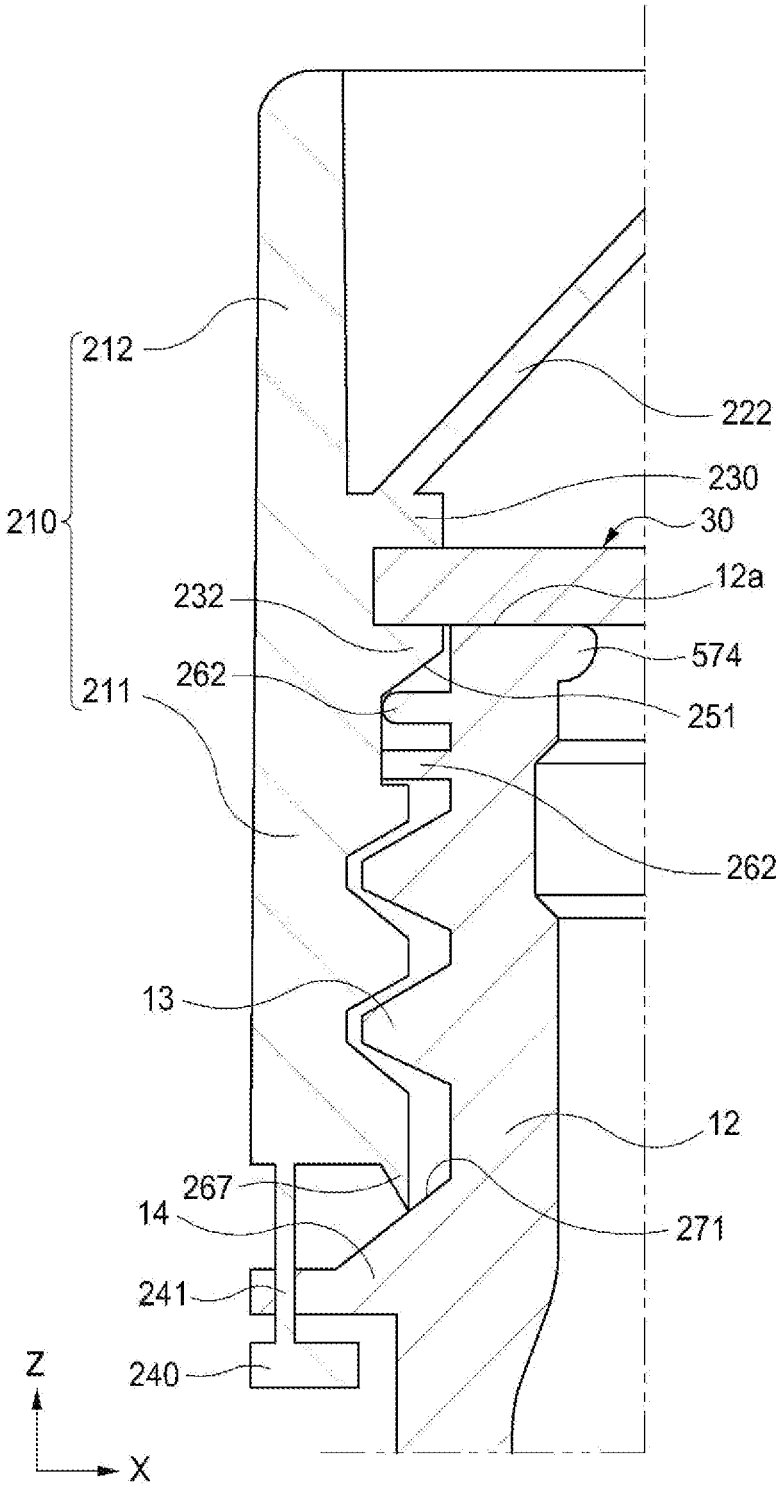
FIG. 21 is an enlarged partial cross-sectional view of a region C of FIG. 19.
Figure 22:
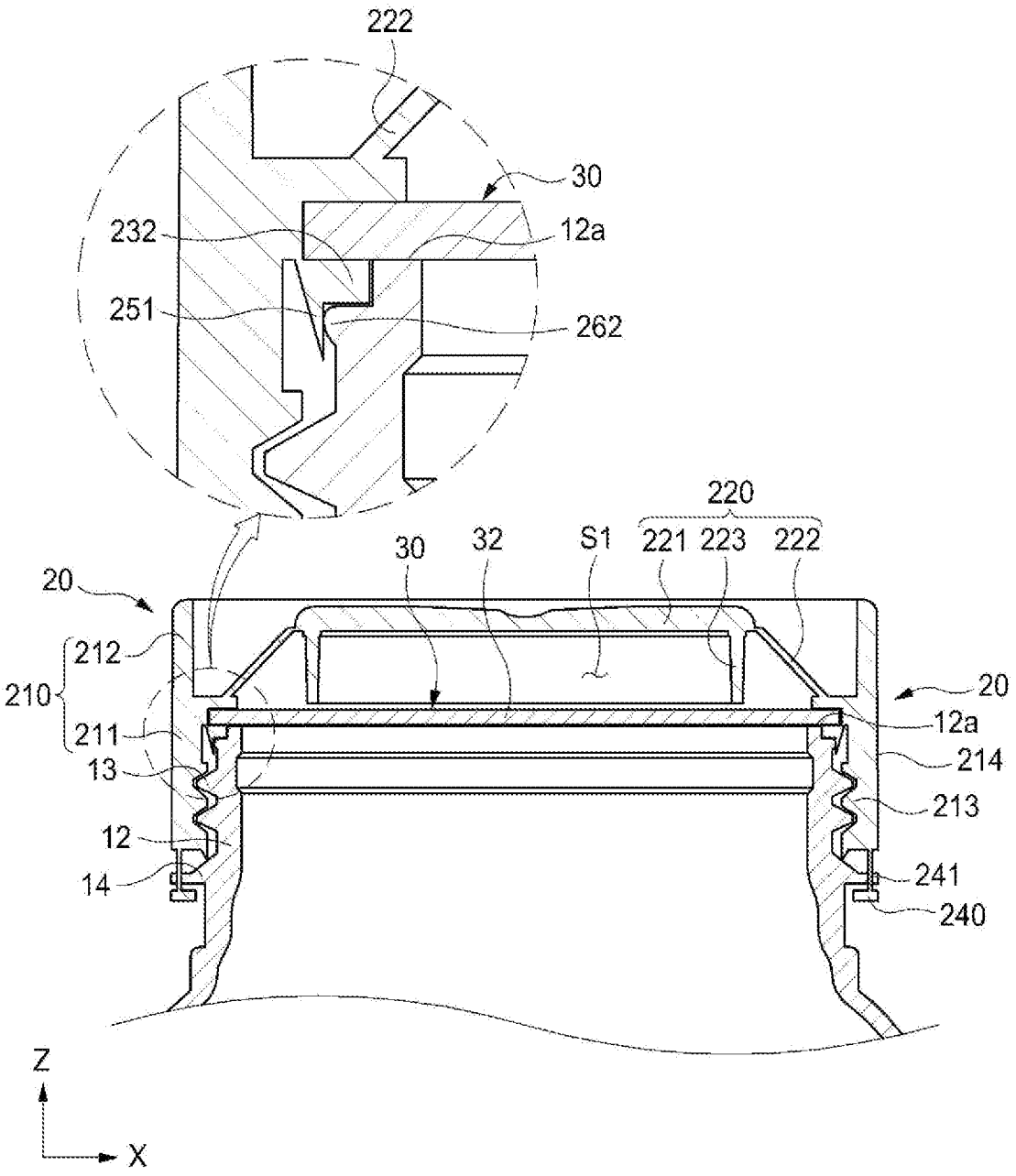
FIG. 22 is a cross-sectional view showing a modified example of a container assembly of FIG. 19.

As illustrated in FIGS. 10B and 21, when the container lid 20 is coupled to the container inlet 12, the inclined surface 254 is lowered and brought into close contact with the outer protruding portion 261 to thereby seal the inside of the container 10.

As a fourth example, a sealing means is provided on the outer circumferential surface of the container inlet 12 near the lower end of the container coupling portion 211 of the container lid 20, and thus, a sufficient sealing force of the container lid 20 to the container 10 may be provided when the container lid 20 is coupled to the container inlet 12.

For example, one or more contact-protruding portions 267 in close contact with a contact surface 271 formed on the outer circumferential side of the container inlet 12 are formed near the lower end of the container lid 20. The outer circumferential side of the container inlet 12 comes into contact with the contact-protruding portions 267, and thus, it is possible to provide the sufficient sealing force of the container lid 20 to the container 10.

The contact-protruding portions 267 are portions which are formed near the lower end of the container lid 20 and brought into close contact with the contact surface 271 formed on the outer circumferential side of the container inlet 12, and one or more contact-protruding portions are brought into close contact with the contact surface 271.

For example, when the container lid 20 is coupled to the container inlet 12, the contact-protruding portions 267 are lowered and brought into close contact with the end and/or side of the contact surface 271 formed on the outer circumferential side of the container inlet 12. Accordingly, it is possible to provide the sufficient sealing force of the container lid 20 to the container 10.

Here, the above-described sealing means may be provided alone or in combination of two or more for the container lid 20 and the container inlet 12.

Also, the sealing means described above are made by mutual combinations of protrusions, grooves, inclinations, and the like, and may be located at different positions in the container lid 20 and the container inlet 12.

That is, an annular protrusion may be formed on one of the container lid 20 and the container inlet 12, and the other one may be configured to come into close contact with the annular protrusion, thereby sealing the inside of the container 10.

The above is merely described with respect to some preferred embodiments that may be implemented according to the present invention. Thus, as is well known, the scope of the present invention should not be construed as being limited by the above embodiments, and the technical ideas of the present invention described above and technical concepts on the basis of these technical ideas are considered to be included in the scope of the present invention.

The invention claimed is:

1. A container assembly comprising:

a container having a container inlet;

a container lid attachable to the container, said container lid comprising:

a lid body and a sealing member detacher, said sealing member detacher comprising a push portion, a connection portion, and pressing portions; and a sealing member having a top surface and a bottom surface; wherein in an initial configuration, the sealing member bottom surface is coupled to the container inlet and the sealing member top surface is coupled to the container lid with a relatively stronger connection, such that when the container lid is removed from the container, the sealing member is separated from the container inlet and retained with the container lid; and wherein the sealing member detacher is configured to remove the sealing member from the container lid body when a user presses downwardly on the push portion.

2. The container assembly of claim 1, wherein the top surface of the sealing member adheres to the container lid.

3. The container assembly of claim 1, wherein the lid body comprises a coupling portion which corresponds to a region coupled to an upper surface of the container inlet and to which an upper surface of an edge of the sealing member is attached.

4. The container assembly of claim 3, wherein the coupling portion has a flat surface in close contact with the top surface of the sealing member.

5. The container assembly of claim 3, wherein one of the coupling portion and an upper end of the container inlet has a groove, and a portion of another one of the coupling portion and the upper end of the container inlet is inserted into the groove so that another one is inserted into and brought into close contact with the one.

6. The container assembly of claim 5, wherein the coupling portion has the groove, and the upper end of the container inlet is inserted into the groove.

7. The container assembly of claim 1, wherein the connection portion is formed integrally with the push portion and the lid body.

8. The container assembly of claim 1, wherein the connection portion, together with the push portion, isolates upper and lower regions of the lid body from each other.

9. The container assembly of claim 1, wherein the connection portion has a plurality of bands that are elastically deformable between an inner circumference of the lid body and the push portion.

10. The container assembly of claim 1, wherein the sealing member detacher is integrally formed with the lid body such that the container is sealed when the lid body is coupled to the container inlet.

11. A container lid attachable to a container having a container inlet, comprising:

a lid body and a sealing member detacher, said sealing member detacher comprising a push portion, a connection portion, and pressing portions; and a sealing member having a top surface and a bottom surface; wherein in an initial configuration, the sealing member bottom surface is coupled to the container inlet and the sealing member top surface is coupled to the container lid with a relatively stronger connection, such that when the container lid is removed from the container, the sealing member is separated from the container inlet and retained with the container lid; and wherein the sealing member detacher is configured to remove the sealing member from the container lid body when a user presses downwardly on the push portion.

12. The container lid of claim 11, wherein the connection portion is formed integrally with the push portion and the lid body.

13. The container lid of claim 11, wherein the connection portion, together with the push portion, isolates upper and lower regions of the lid body from each other.

14. The container lid of claim 11, wherein the connection portion has a plurality of bands that are elastically deformable between the inner circumference of the lid body and the push portion.

15. The container lid of claim 11, wherein the sealing member detacher is integrally formed with the lid body such that the container is sealed when the lid body is coupled to the container inlet.

* * * * *